US006634638B2

(12) United States Patent
Toda et al.

(10) Patent No.: US 6,634,638 B2
(45) Date of Patent: Oct. 21, 2003

(54) PAPER FEED TRAY

(75) Inventors: Takashi Toda, Iwatsuki (JP); Hiroyoshi Ogawa, Iwatsuki (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 10/000,949

(22) Filed: Dec. 4, 2001

(65) Prior Publication Data

US 2003/0006546 A1 Jan. 9, 2003

(30) Foreign Application Priority Data

Jul. 4, 2001 (JP) ..... 2001-203629

(51) Int. Cl.[7] ..... B65H 1/00
(52) U.S. Cl. ..... 271/162; 271/170; 271/171
(58) Field of Search ..... 271/162, 164, 271/170, 171, 145

(56) References Cited

U.S. PATENT DOCUMENTS 3,907,283 A * 9/1975 Miller ..... 271/164 X
4,780,740 A * 10/1988 Fukae ..... 271/171 X
5,163,670 A * 11/1992 Sellers et al. ..... 271/157
5,238,238 A * 8/1993 Shinohara et al. ..... 271/145
5,975,517 A * 11/1999 Lim ..... 271/162 X
6,332,610 B1 * 12/2001 Hiura ..... 271/171
6,364,309 B1 * 4/2002 Tomatsu ..... 271/160
6,435,499 B1 * 8/2002 Tomatsu ..... 271/162 X

* cited by examiner

*Primary Examiner*—David H. Bollinger
(74) *Attorney, Agent, or Firm*—Oliff & Berridge, PLC.

(57) ABSTRACT

All the constituent members of a tray 1, for example, a side guide 30, a paper separating claw 50, a tray body 10, a drawing handle member 70, a member for regulating an end guide 40, and a holding member for holding a retard roll 60 each have a snap-fit structure. Therefore, the assembling and disassembling of the tray can be easily performed. The tray is formed only from members that enable all the steps of processes of assembling and disassembling the tray to be performed from the same direction without changing the orientation of the tray.

16 Claims, 25 Drawing Sheets

PAPER FEED TRAY

BACKGROUND OF THE INVENTION

1. Field of the Invention

The present invention relates to a structure of a paper feed tray for use in an image forming apparatus, such as a printer, a copying machine, a facsimile machine, and a composite machine thereof.

2. Description of the Related Art

A paper feed tray of an image forming apparatus comprises components, such as a casing, a paper loading plate provided on the bottom portion of the casing for loading paper thereon, a side guide for regulating a side portion of a sheet of paper, an end guide for determining a position of a tail edge of a sheet of paper, a paper separating claw for separating paper sheet by sheet, a retard roll, and a casing attaching/detaching handle. Trays each enabled to accommodate 250 sheets of paper (that is, a half pack) or more need to ensure sufficient stiffness thereof. Further, there is necessity for assembling each of components into the tray with good accuracy so that sheet conveying performance is maintained even when a sheet conveying speed is increased to a high value. Therefore, a paper feed tray according to the related art necessarily has a structure in which many screws are tightened. This results in complex assembling and increase in cost of the tray. Moreover, when being conscious of recycling of the tray, disassembling thereof requires a great deal of labor in case that there are many places, to each of which a screw is fastened, in the tray. Simultaneously, it takes time and labor to sort out individual members thereof into a group of members to be recycled and another group of members to be scrapped.

Furthermore, generally, the greater part of the paper feed tray is made of a resin so as to reduce the cost and weight thereof. When being conscious of reuse of each of components of the paper feed tray, it is necessary to disassemble the paper feed tray without damaging the components made of a resin. When screws are fastened to the components made of a resin, screw holes are damaged during the disassembling of the paper feed tray. Thus, it is difficult to reassemble the paper feed tray by using the same screw holes.

SUMMARY OF THE INVENTION

In view of such circumstances, an object of the invention is to substantially improve the structure of a paper feed tray for use in an image forming apparatus and to provide a paper feed tray that is easily assembled and disassembled and that is rational in relation recycling, reuse, and disposal.

The invention is accomplished to solve the aforementioned problems. According to a first aspect of the invention, there is provided a paper feed tray comprising a casing, a paper loading plate for loading paper thereon, the paper loading plate provided on a bottom portion of the casing, a side guide for regulating a side portion of a sheet of paper, an end guide for determining a position of a tail edge of a sheet of paper, a paper separating member for separating paper sheet by sheet, a casing attaching/detaching handle, an operation tab for operating the side guide, and a catching portion for catching the paper separating member, the catching portion formed between the side guide and the operation tab. In this case, it is preferable that the paper separating member is a paper separating claw and a fulcrum of the paper feed claw is formed to be integral with a shaft for fitting the operation tab into the side guide. Further, it is preferable that a snap is disposed so that a force received by the paper separating claw from paper during supply of paper acts in a direction in which snap-fitting performed on the operation tab to be utilized at assembling of the tray does not become off. Furthermore, a paper feed tray of the invention may have a structure which includes a slit portion that elastically opens and tentatively holds a paper separating claw in a retreat position and is formed between an operation tab member and a side guide as means for avoiding a paper separating claw serving as a hindrance to assembling of a paper loading plate. The invention provides a paper feed tray having a structure that comprises a regulating member for regulating a movable range of the paper separating claw so as to satisfy paper feed performance. In this tray, this regulating member has a structure adapted to bend owing to the elasticity thereof. Further, when assembling the tray, the regulating member bends in such a way as to prevent the paper separating claw from interfering with another member to avoid the paper separating claw. At that time, the paper separating claw and the regulating member may be placed so that even when the regulating member for regulating the movable range of the paper separating claw is bent by a force, which is received by the regulating member during the supply of paper, the separating claw is firmly regulated in a direction in which the separating claw is prevented from escaping from a normal position thereof to be regulated.

Further, according to a second aspect of the invention, there is provided a paper feed tray comprising a tray body, a drawer handle member provided on the tray body, for attaching/detaching the tray body to/from an image forming apparatus, the drawer handle member constituting a part of an exterior cover of the image forming apparatus, and a fixing member having an elastic piece and an engaged portion, wherein the elastic piece is elastically deformable, has an engaging portion, and is provided on one of the tray body and the drawer handle member, the engaged portion and is provided on the other thereof, the tray body and the drawer handle member comprise at least two constituent members, the engaging portion and the engaged portion is engaged with each other to fix the tray body and the drawer handle member to each other. At that time, it is preferable that the fixing member consists of the elastic piece and the engaged portion. Further, it is preferable that when the tray body is attached to and detached from the image forming apparatus, a direction of a force applied to the fixing member is different from a direction in which the engaging portion is engaged with the engaged portion. Moreover, it is preferable that when the tray body is lifted by holding the drawer handle member, a direction of a force applied to the fixing member is different from a direction in which the engaging portion is engaged with the engaged portion. Furthermore, a direction in which the engaging portion is engaged with the engaged portion may be substantially perpendicular to a direction in which the tray body is attached to and detached from the image forming apparatus. Further, it is preferable that the tray body and the drawer handle member are made of different synthetic resins and the synthetic resin constituting the tray body is a more durable material than that constituting the drawer handle member. Moreover, it is preferable that the paper feed tray further comprises a pair of plate-like arm members provided at both end portions of the drawer handle member, respectively, the plate-like members extended in a direction in which the tray body is attached to and detached from the image forming apparatus, wherein a force received from the tray body is applied to each of the arm members in a direction perpendicular to a direction of thickness thereof. Furthermore, wherein each of the arm members may be provided to abut against a wall surface that is provided on a sidewall of the tray body and extends in a direction substantially perpendicular to the direction in which the tray body is attached to and detached from the image forming apparatus. Incidentally, it is preferable that a space is provided adjacent to the elastic piece. Preferably, the space is a concave portion provided in the sidewall of the tray body.

Further, according to a third aspect of the invention, there is provided A paper feed tray comprising a tray body, a drawer handle member provided on the tray body, for attaching/detaching the tray body to/from an image forming apparatus and, the drawer handle member constituting a part of an exterior cover of the image forming apparatus, a fixing member for fixing the tray body and the drawer handle member to each other, provided on one of the tray body and the handle drawer member, an arm member having a plate-like shape, being elastically deformable, and extending in a direction in which the tray body is attached to and detached from the image forming apparatus, a fixing portion for positioning and fixing the arm member, provided on the other thereof. In this case, it is preferable that the arm member is provided to be parallel to a sidewall of the tray body and the fixing portion abuts against a plate-thickness surface of the arm member to position and fix the arm member. Further, it is preferable that the arm member is elastically deformable in a direction substantially perpendicular to a direction in which the tray body is attached to and detached from the image forming apparatus.

Next, the invention provides another paper feed tray, which comprises a regulating member, provided in an end guide enabled to correspond to a plurality of paper lengths and to easily move, for holding a base of the end guide and for regulating a moving operation in such a way as to prevent the end guide from slipping off. In this tray, the regulating member is a member adapted to have elasticity in itself. In this tray, the regulating member for holding the base of the end guide and for regulating a moving operation in such a way as to prevent the end guide from slipping off may be a member adapted to be bent when attached to and detached, and to enable the end guide to easily move without detaching the end guide.

It is preferable that the elastic member having elasticity is a resin sheet member. Further, a regulating member, which is provided in an end guide enabled to correspond to a plurality of paper lengths and to easily move, for holding the base of the end guide and for regulating a moving operation in such a way as to prevent the end guide from slipping off, may be a member to be assembled from assembly members each having elasticity so as to easily assemble the tray by utilizing the elasticity without a tool.

Another paper feed tray is preferable, in which the members each serving as the assembly member and having elasticity in itself are easily assembled into the regulating member without a tool by utilizing the elasticity, and has a part to be bent when assembled, and another part to be bent when operated by a user, and in which the part to be bent when assembled, and the part to be bent when operated by a user are formed separately from each other.

Another preferable paper feed tray may have a structure in which a projection portion, provided on a retard roll holding member, for regulating an own position, and an attachment-side positioning member having elasticity. When the tray is assembled, the attachment-side positioning member is pushed up by the projection portion provided on the retard roll holding member for regulating the position, so that the positioning member is enabled to move to a normal position.

As described above, according to the invention, all the attaching members for attaching constituent members of the tray to one another have a snap-fit structure to thereby enable easy assembling and disassembling thereof. Further, the paper feed tray is constituted only by members that enable all steps of processes of assembling and disassembling the tray to be performed from the same direction without changing orientation of the tray. Consequently, the invention contributes to reduced labor and cost.

DETAILED DESCRIPTION OF THE PREFERRED EMBODIMENTS

Figure 25:
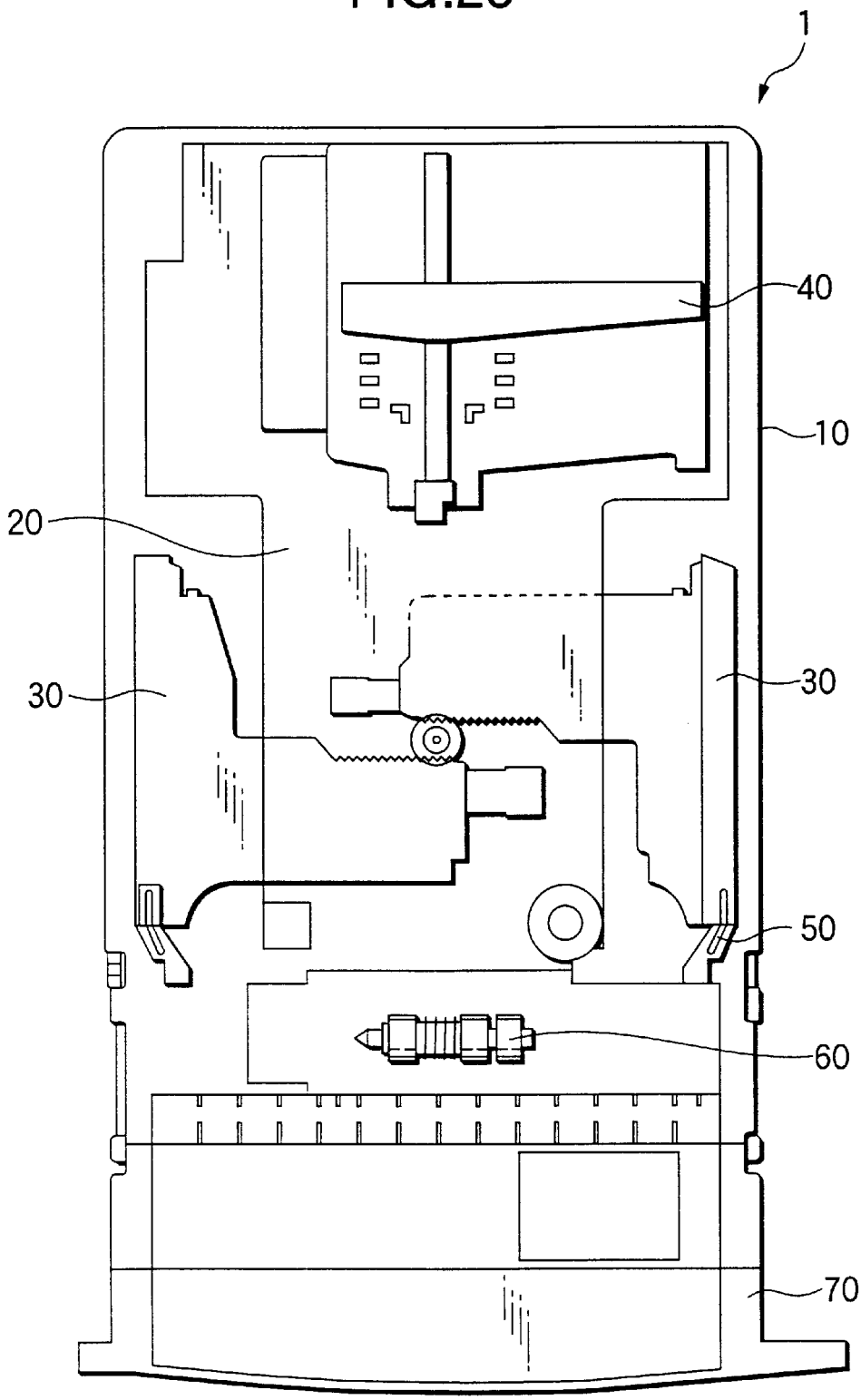
FIG. 25 is a plan view illustrating the entire paper feed tray.
Figure 26:
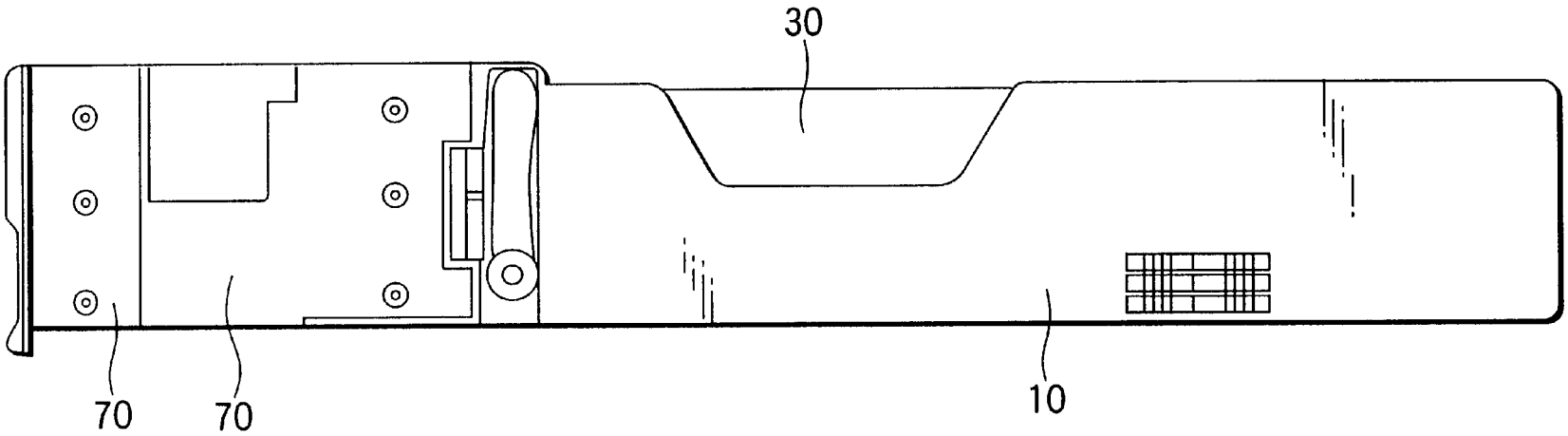
FIG. 26 is a side view illustrating the entire paper feed tray.

Hereinafter, an embodiment of the invention is described with reference to the accompanying drawings. FIG. 25 illustrates a plan view of a paper feed tray 1. FIG. 26 illustrates a side view thereof. A paper feed tray 1 has a casing 10, a paper loading plate 20, a side guide 30, an end guide 40, a paper separating claw 50, a retard roll 60, and a casing inserting/removing handle 70. The casing 10 is a box-like one for the paper feed tray 1, comprises a base plate and sidewall plates that surround periphery of the casing 10, and is opened in the top surface thereof. The paper loading plate 20 is a plate-like tray to be disposed on the base plate of the casing 10, provided with an ascending gradient in a direction in which paper travels, and has an elevating function of going up and down according to an amount of paper. The side guide 30 regulates both sides of paper contained in the paper feed tray 1 to guide the paper by holding the paper at a central portion in a direction of width thereof. Further, the side guide 30 has walls erected and provided at the left-hand side and the right-hand side thereof, respectively. An operation tab is mounted on each of the erected walls so that distance between the erected walls can be adjusted to the width of paper according to the paper size. The end guide 40 is a member for positioning the tail edge of the paper and adapted to be moved to a certain position according to the length of the paper to be set at such a position. The paper separating claw 50 is an oscillating member that has claws provided at both sides of an end in a direction in which paper is fed and that handles sheets of paper to separate the paper sheet by sheet and to send out the separated sheet of paper. This paper separating claw 50 is attached to the side guide 30 or is movable in the direction of width of paper together with the side guide 30. The retard roll 60 is a roll provided at a central portion of a paper output end for permitting the paper to smoothly travel in a direction in which the paper is sent out and provided on the base plate of the casing. The casing inserting/removing handle 70 is a handle provided at the loading side rear end of the casing 10 for inserting/removing the entire paper feed tray 1 into/from a printer body.

Figure 1:
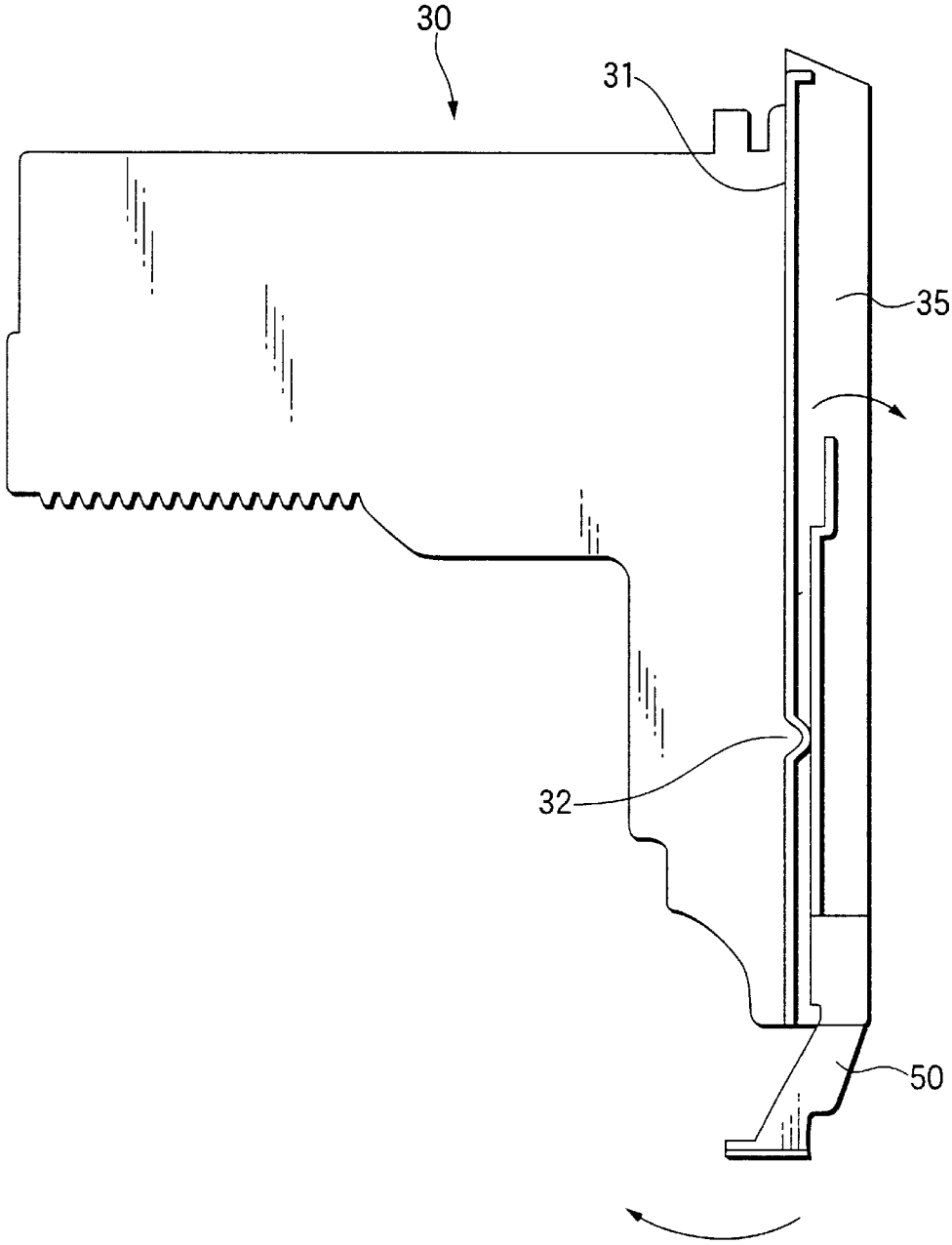
FIG. 1 is a plan view illustrating a paper separating claw, a side guide, and an operation tab.
Figure 2:
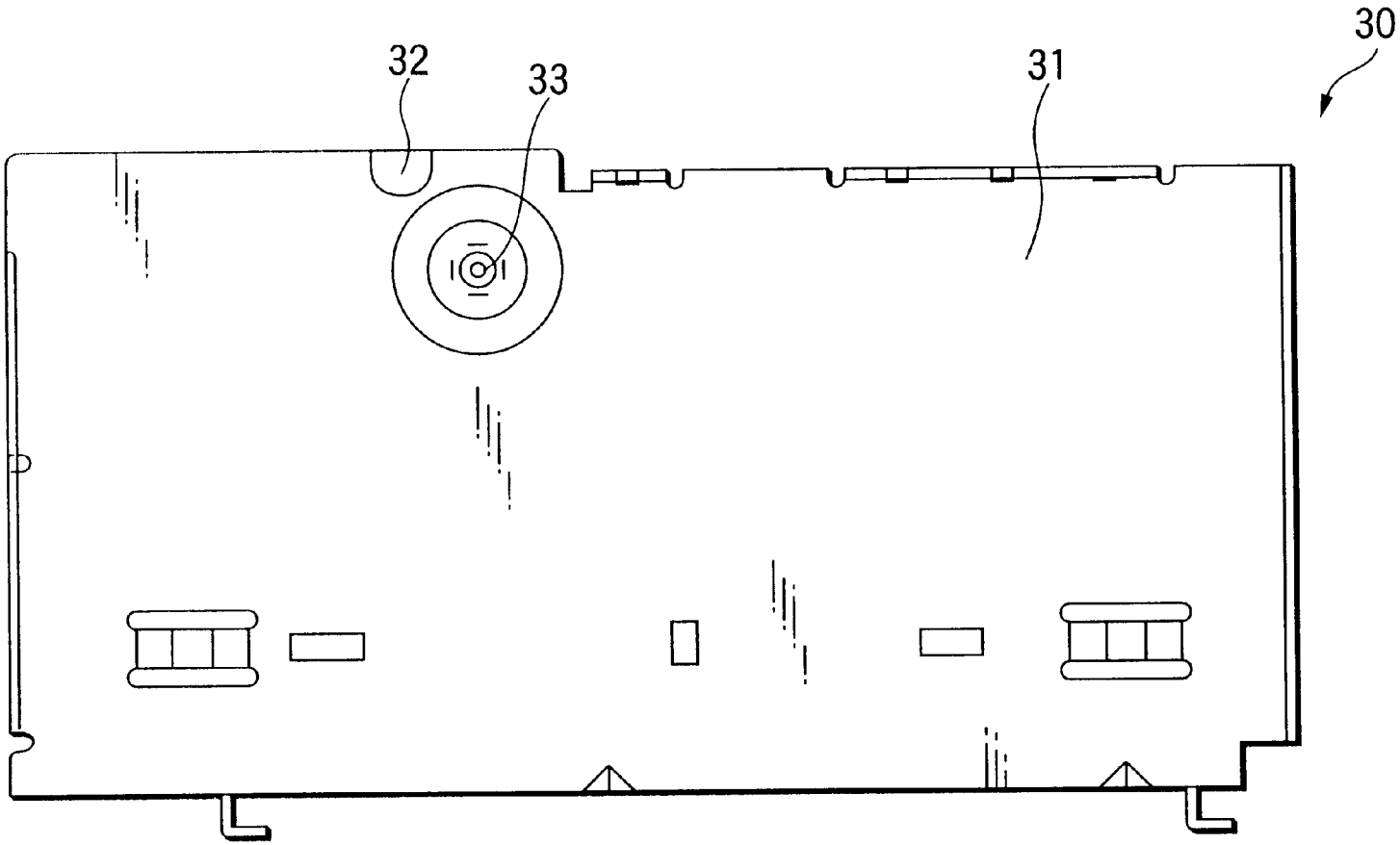
FIG. 2 is a side view illustrating the side guide.
Figure 3:
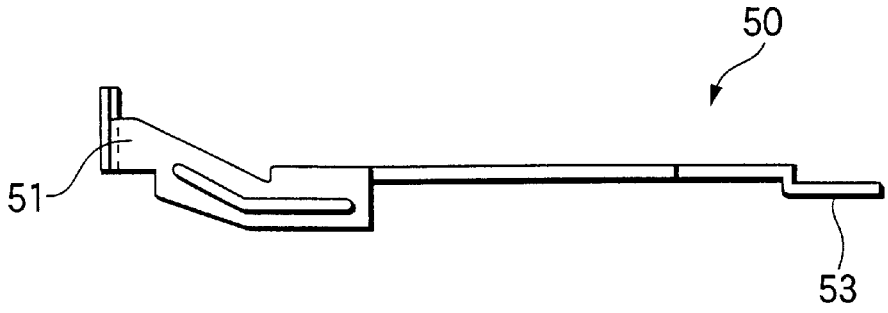
FIG. 3 is a plan view illustrating the paper separating claw.
Figure 4:
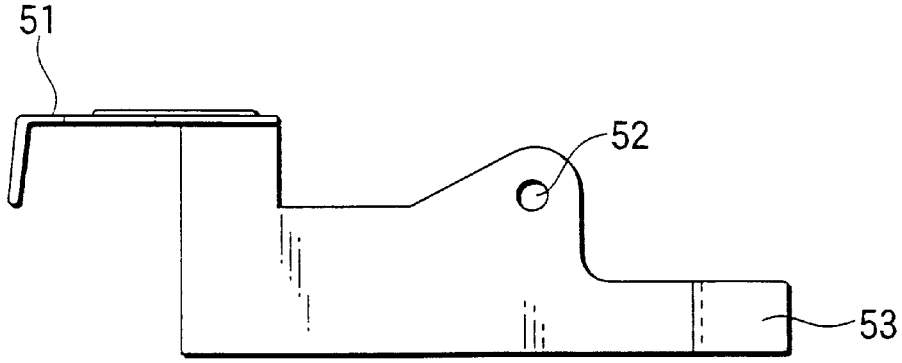
FIG. 4 is a side view illustrating the paper separating claw.

FIG. 1 is a plan view illustrating the side guide 30 and the paper separating claw 50 according to the embodiment of the invention. FIG. 2 is a side view illustrating the side guide 30. According to the invention, the paper feed tray is configured so that the paper separating claw 50 is caught between a side plate 31 of the side guide 30 and an operation tab 35. Thus, the member configuration of the paper feed tray is simplified. In the paper feed tray according to the invention, a catching portion is formed. When the catching portion is attached to an operation tab attaching hole 33 provided in the sidewall 31 of the paper side guide 30, the catching portion catches the paper separating claw 50 together with the operation tab 35. The paper separating claw 50 has a nail 51 for holding an edge of paper and swings around a fulcrum 52 in a direction in which the claw goes up and down, as illustrated in a plan view thereof shown in FIG. 3 and in a side view thereof shown in FIG. 4. The paper separating claw 50 also has an oscillation regulating portion 53. According to the invention, regarding the fulcrum of the paper separating claw 50 is formed to be integrated with a shaft of the operation tab 35 to be fitted into the sidewall 31 of the side guide 30. Consequently, this enables simultaneous attachment of the paper separating claw 50 and the operation tab 35 to the side guide 30 during an assembling operation of attaching the paper separating law 50 thereto.

Figure 5:
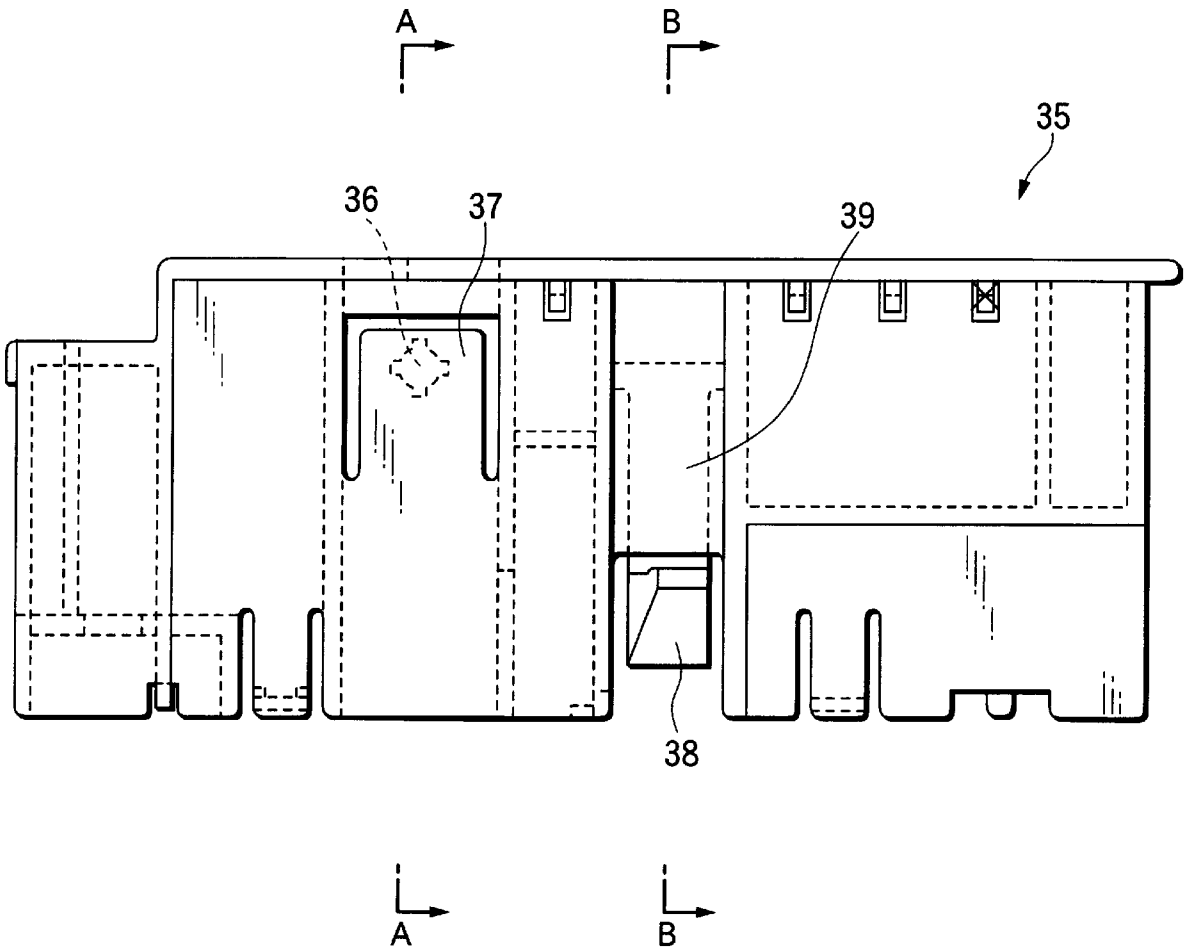
FIG. 5 is a side view illustrating the operation tab.
Figure 6:
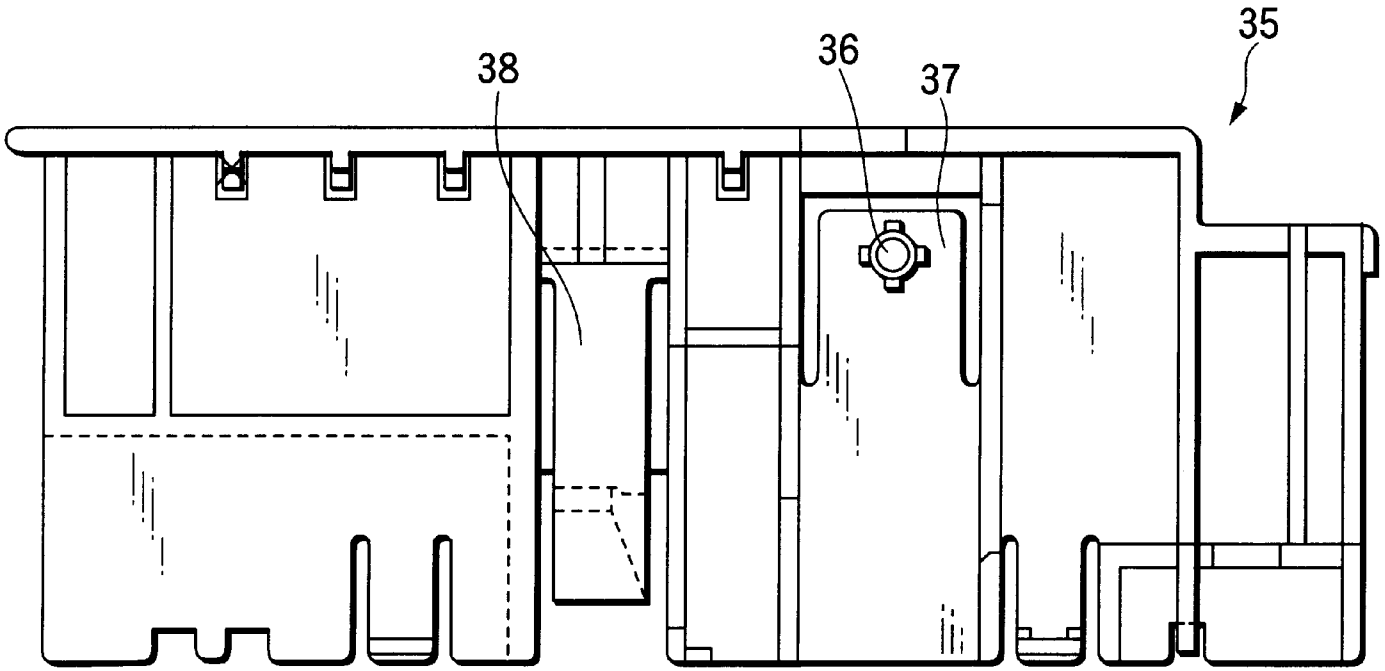
FIG. 6 is a rear view illustrating the operation tab.
Figure 7:
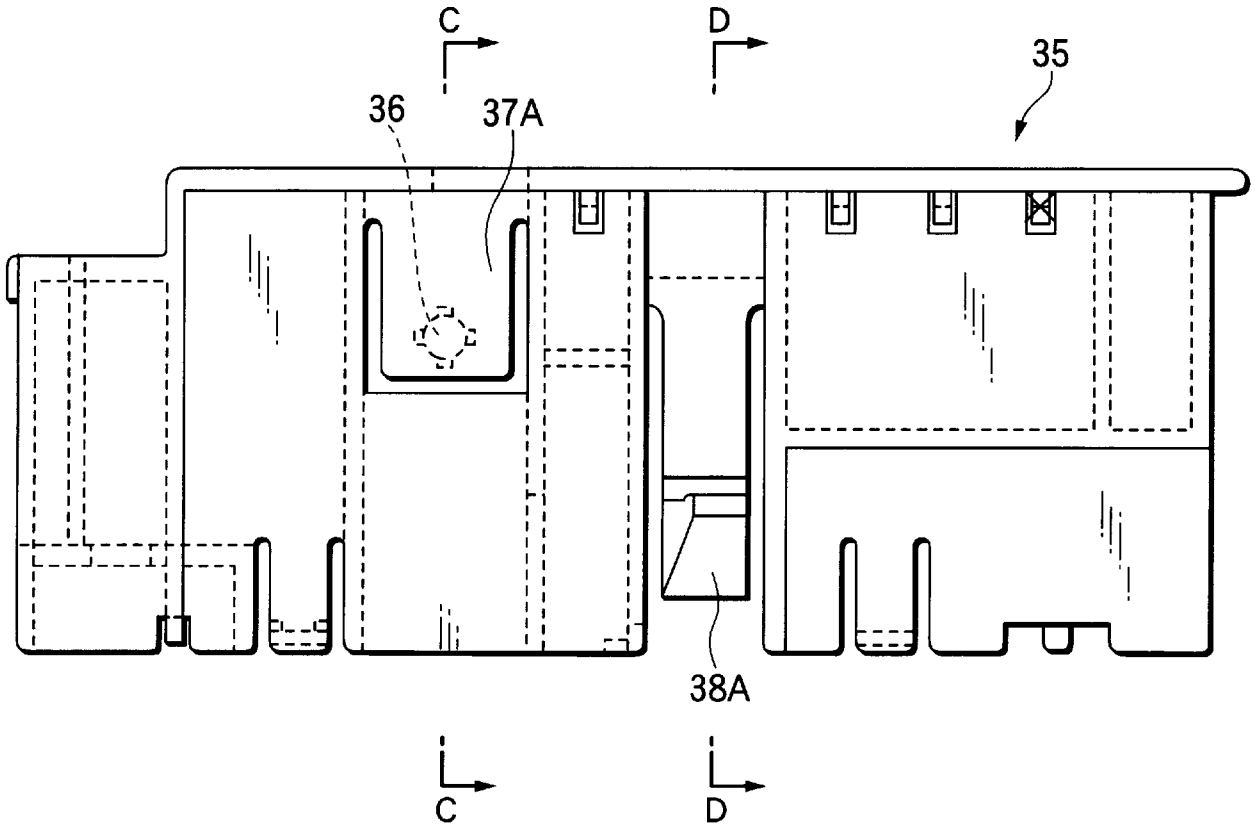
FIG. 7 is a side view illustrating another operation tab.

FIG. 5 illustrates a side view of an example of the operation tab 35. FIG. 6 illustrates a rear view of FIG. 5. FIG. 7 illustrates a side view of another example of the operation tab 35. The shaft 36 to be fitted into the side guide 30 shown in FIGS. 5 to 7 is made to coincide with an oscillation center hole 52. To facilitate the attachment of the shaft 36, a U-shaped cutout is formed in a wall of this part of the operation tab 35 to form a flexible portion 37. The example shown in FIG. 5 differs from that shown in FIG. 7 in a direction in which the cutout of this flexible portion 37 is formed. Further, a snap 38 for nipping the oscillation regulating portion 53 of the paper separating claw 50 is provided.

The paper separating claw 50 is snap-fitted into the snap 38 provided in the operation tab 35. This snap 38 sets the paper separating claw 50 so that a force received by the paper separating claw 50 from paper during supply of the paper acts in a direction in which the snap-fitting of the paper separating claw 50 into the snap 38 to be utilized at the assembling of the tray is not off. During the supply of paper, the paper separating claw 50 undergoes pressure exerted thereon by the paper from below. This pressure is concentrated on the shaft 36 of the paper separating claw 50. According to the invention, the snap 38 is disposed so that when a force is applied onto the shaft, the force acts in a direction in which the snap-fitting to be made to function during the assembling of the tray is not off. This is concretely described hereinbelow.

Figure 8:
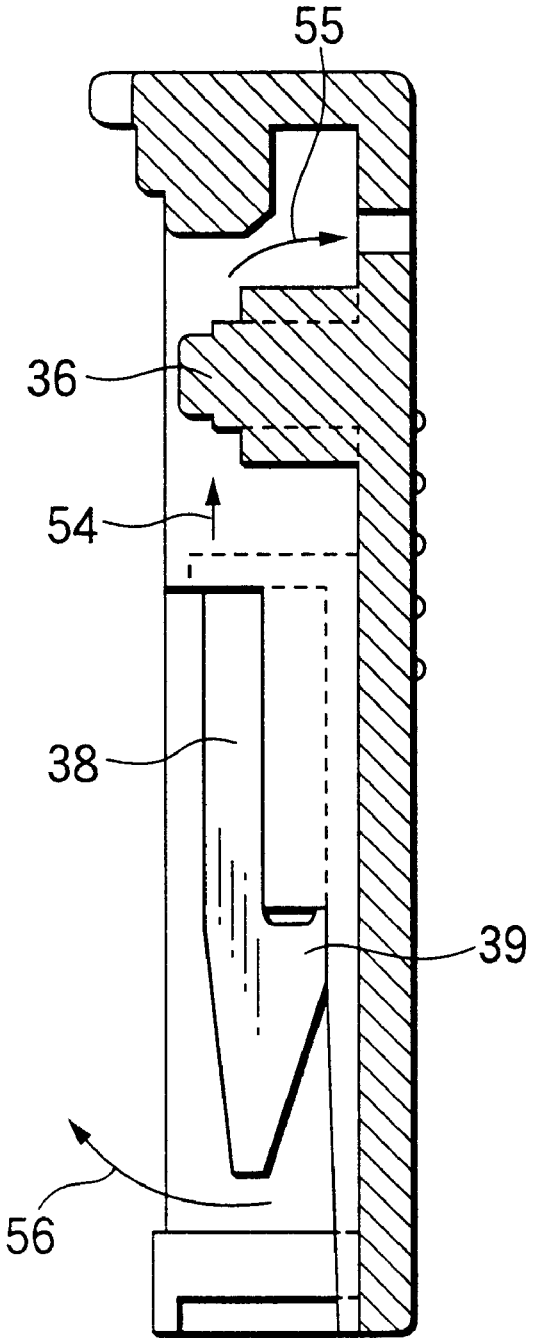
FIG. 8 is a sectional view taken in a direction of arrows along line A—A of FIG. 5.
Figure 9:
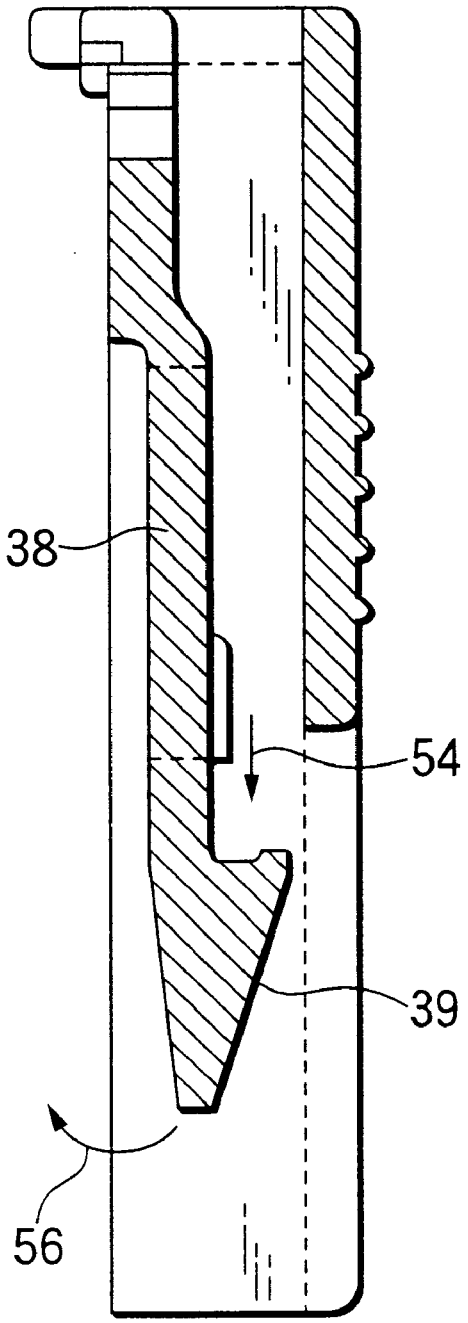
FIG. 9 is a sectional view taken in a direction of arrows along line B—B of FIG. 5.

FIG. 8 illustrates a sectional view taken in a direction of arrows along line A—A of FIG. 5. FIG. 9 illustrates a sectional view taken in a direction of arrows along line B—B of FIG. 5. As shown in FIG. 8, the shaft 36 is a shaft that attaches the operation tab 35 to the sidewall 31 of the side guide 30 and supports the oscillation center hole 52 of the paper separating claw 50. When a load 54 exerted by the paper separating claw 50 upwardly acts on the shaft 36 from below, a clockwise moment acts on the shaft 36 as indicated by an arrow 55 shown in FIG. 8, because of the U-shaped cutout formed in the wall of the shaft attaching portion to be opened in the lower part thereof. Thus, the shaft 36 shown in FIG. 9 tends to bend in a direction in which the flexible portion 37 opens and the claw 50 slips off. At that time, a lower part of the snap 38 tends to swing clockwise around an upper part thereof serving as a fulcrum. Therefore, the shaft 36 tends to bend in a direction in which a stopper claw 39 comes off.

Figure 10:
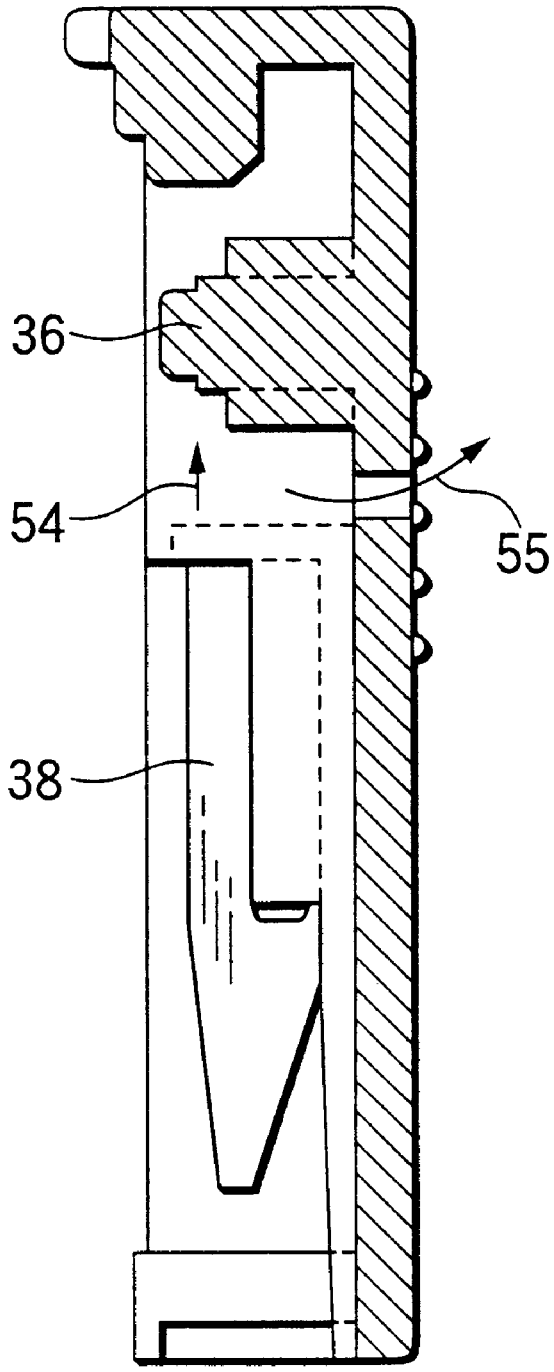
FIG. 10 is a sectional view taken in a direction of arrows along line C—C of FIG. 7.
Figure 11:
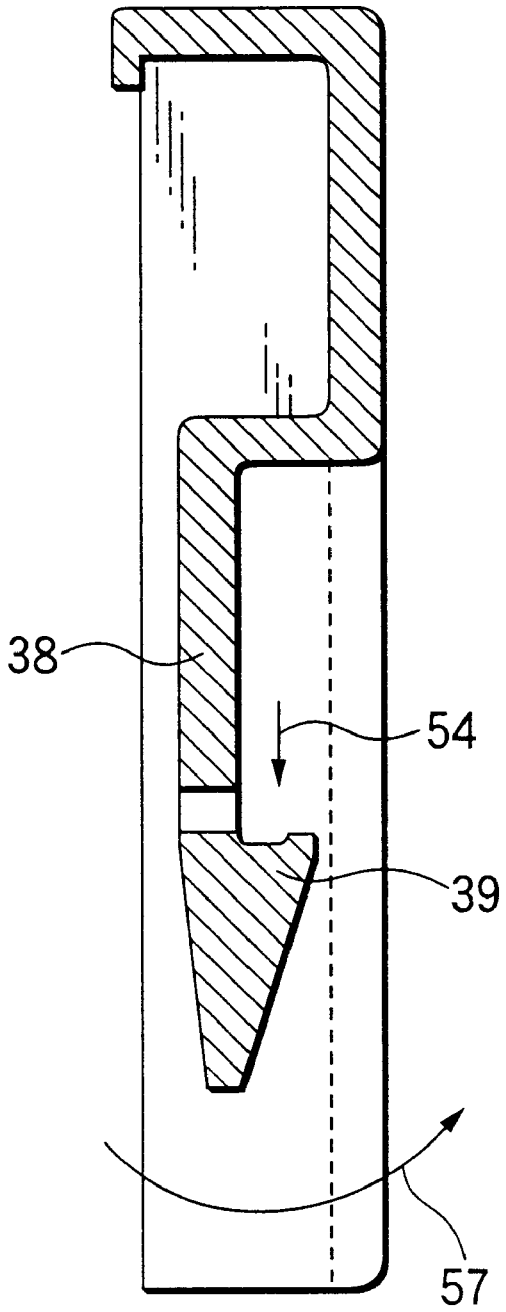
FIG. 11 is a sectional view taken in a direction of arrows along line D—D of FIG. 7.

FIG. 10 shows a sectional view taken in a direction of arrows along line C—C of FIG. 7. FIG. 11 is a sectional view taken in a direction of arrows along line D—D of FIG. 7. In this case, when a counterclockwise moment indicated by the arrow 55 is applied thereto, the moment acts in a direction in which the shaft 36 cuts into the side plate of the side guide. Furthermore, in FIG. 11, a counterclockwise moment is applied thereto so that the snap 38 swings counterclockwise around the fulcrum as indicated by an arrow 57. Thus, the snap 38 bends in a direction in which the stopper claw 39 digs thereinto. Therefore, the operation tab 35 having the shape shown in FIGS. 10 and 11 is more preferable than that having the shape shown in FIGS. 8 and 9.

Figure 12:
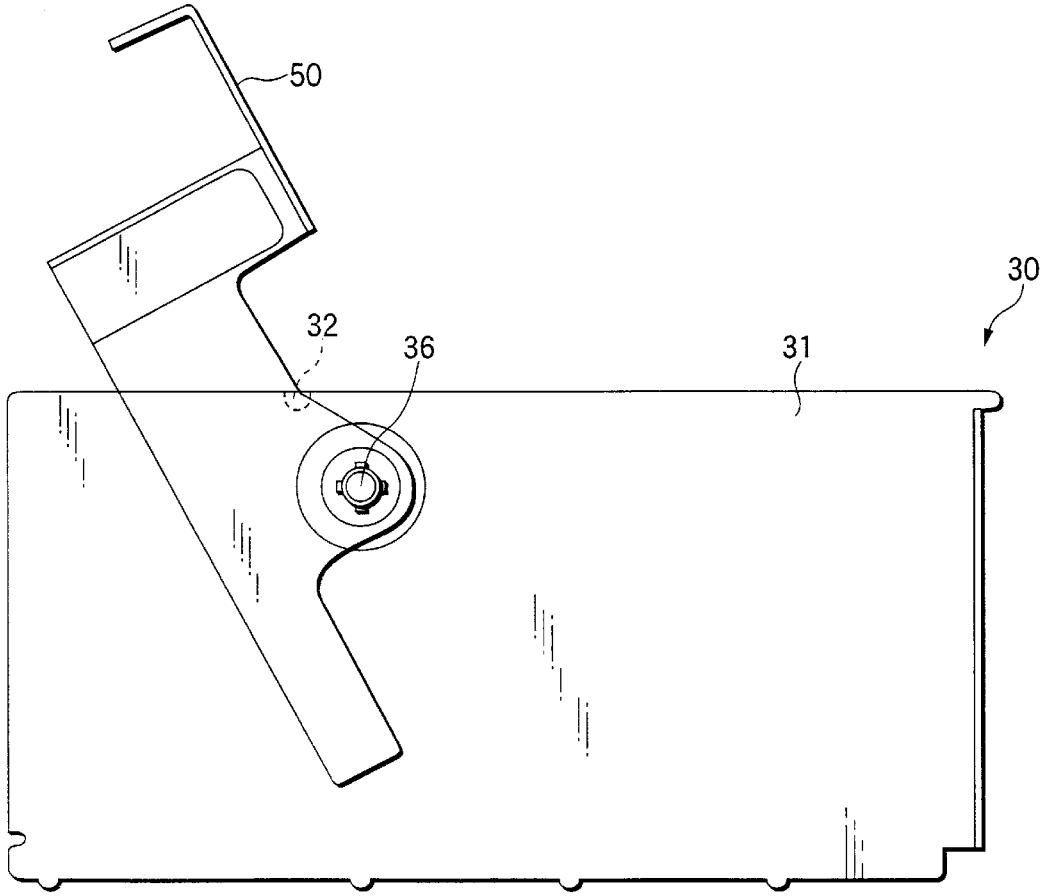
FIG. 12 is a side view illustrating a retreating state of the paper separating claw.

When the paper loading plate 20 is assembled, a paper separating claw 50 is an hindrance to the assembling thereof. As illustrated in FIGS. 1 and 2, a projection 32 is provided on a part of the sidewall 31 of the side guide 30 as means for avoiding this hindrance so as to be able to tentatively catch and hold the paper separating claw 50 between the side guide 30 and the operation tab 35 by utilizing the elasticity of the operation tab 35. That is, to avoid the paper separating claw 50 serving as a hindrance to the assembling of the paper loading plate 20 and to fix the paper separating claw 50 to a temporary avoidance position, a narrow slit portion is provided between the operation tab 35 and the sidewall 31 of the side guide. As illustrated in FIG. 12, when the paper separating claw 50 is swung, the slit between the projection 32 and the operation tab 35 is slightly widened by the elasticity of the operation tab 35. Then, the paper separating claw 50 is caught between the sidewall 31 of the side guide 30 and the operation tab 35 so that the oscillating position of the paper separating claw 50 can be retained. This mechanism portion can be effectively utilized when the paper separating claw is assembled.

Figure 13:
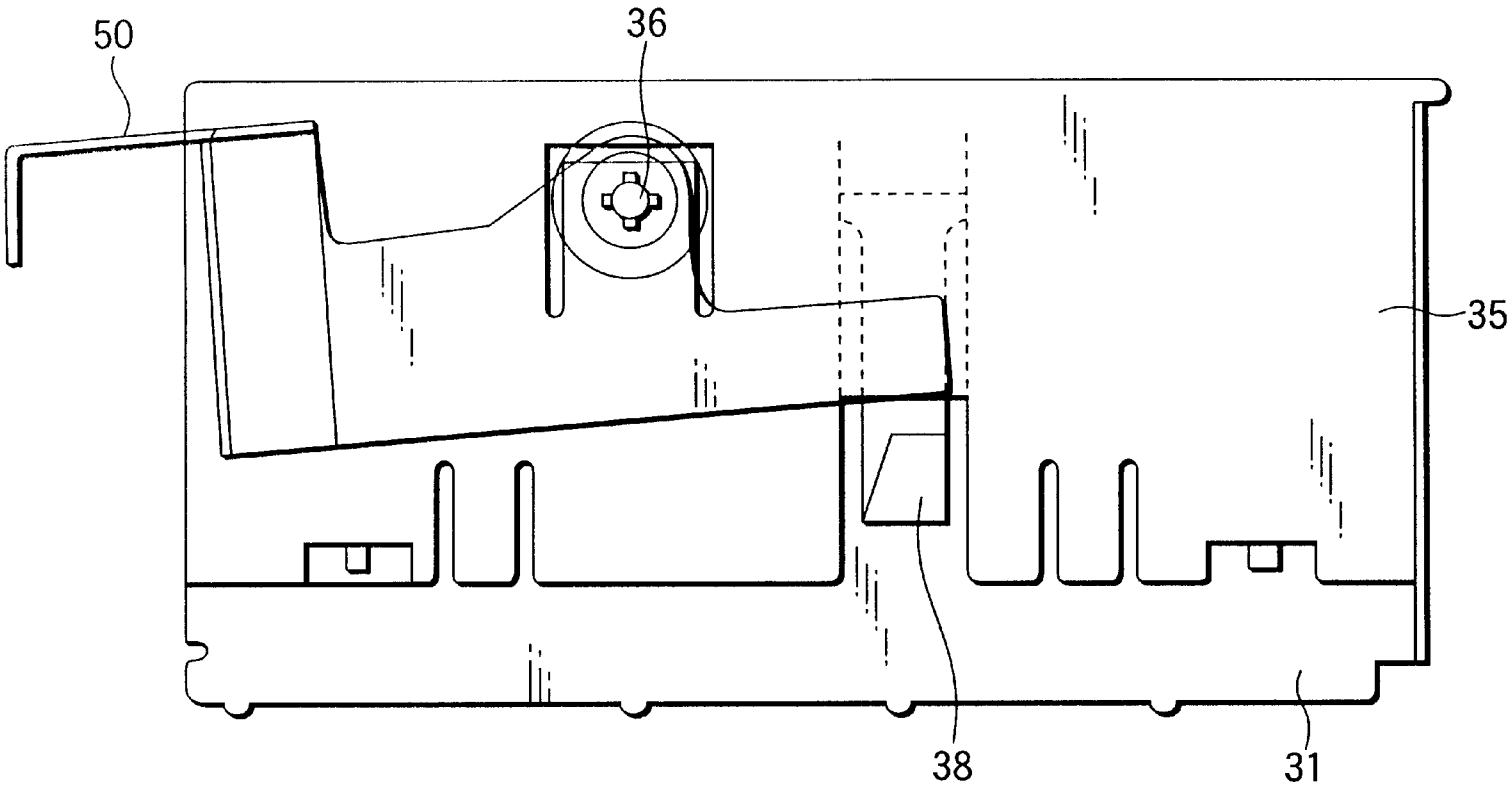
FIG. 13 is a side view illustrating a mounting state of the paper separating claw.

In order to satisfy the paper feed performance, a member for regulating a moveable range of the paper separating claw 50 is provided in a tail portion of the paper separating claw 50, as shown in FIG. 13. This regulating member 38 is formed in the operation tab 35 to have a claw structure member and to bend owing to elasticity thereof. The paper separating claw 50 and the regulating member 38 are disposed so that when the regulating member 38 for regulating the movable range of the paper separating claw 50 is bent by force, which this member undergoes during the paper is supplied, in a direction in which the force is prevented from escaping. When the paper separating claw 50 is assembled, the claw 50 has a structure, for example, a snap-fit structure, in which the regulating member 38 bends so that the paper separating claw 50 can avoid so as not to interfere with other members. The regulating member 38 has a shape and structure of a claw, which allow the regulating member 38 to bend when a force is applied thereto during the supply of paper to prevent the paper separating claw 50 from escaping.

Figure 14:
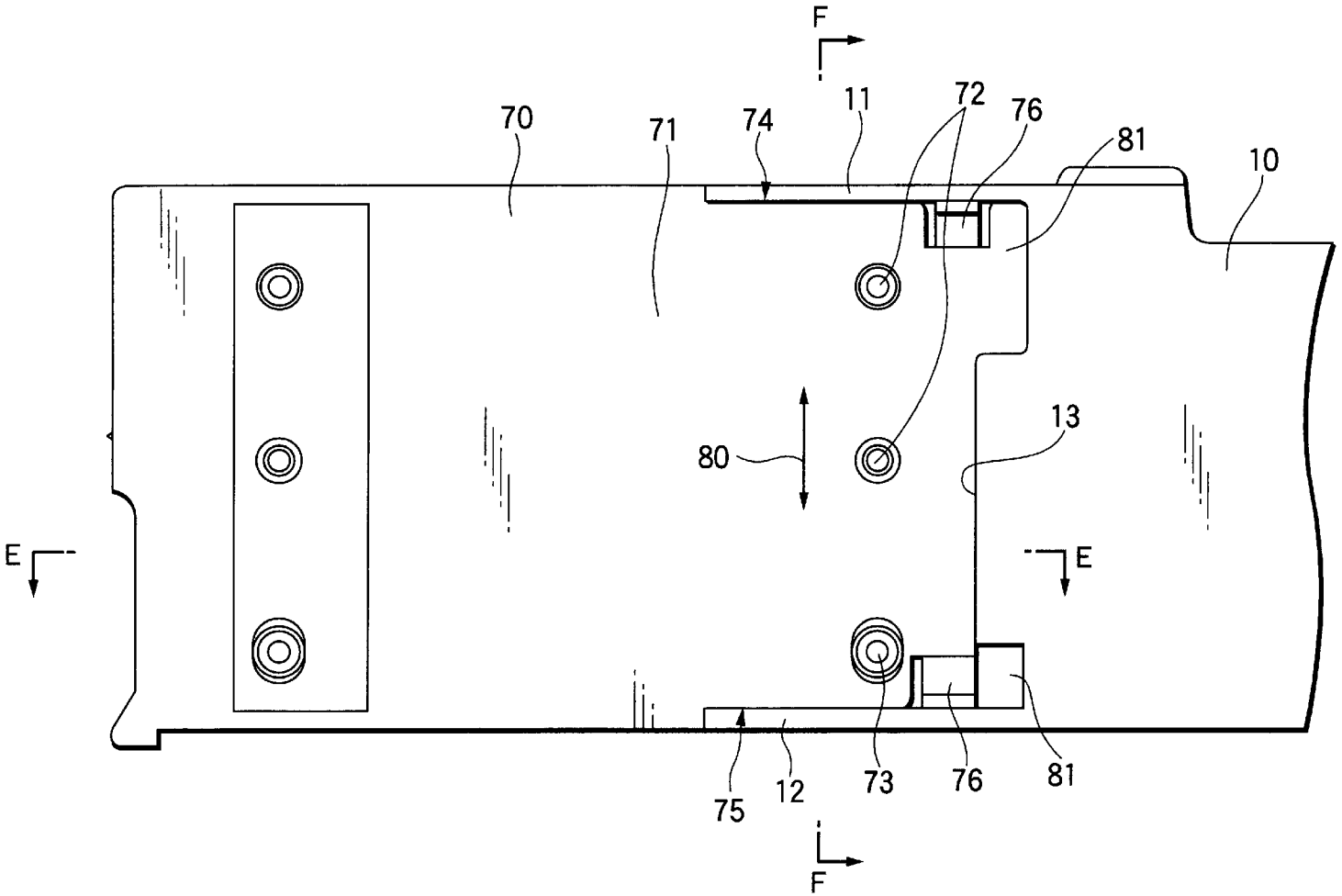
FIG. 14 is a side view illustrating a handle attaching portion.
Figure 15:
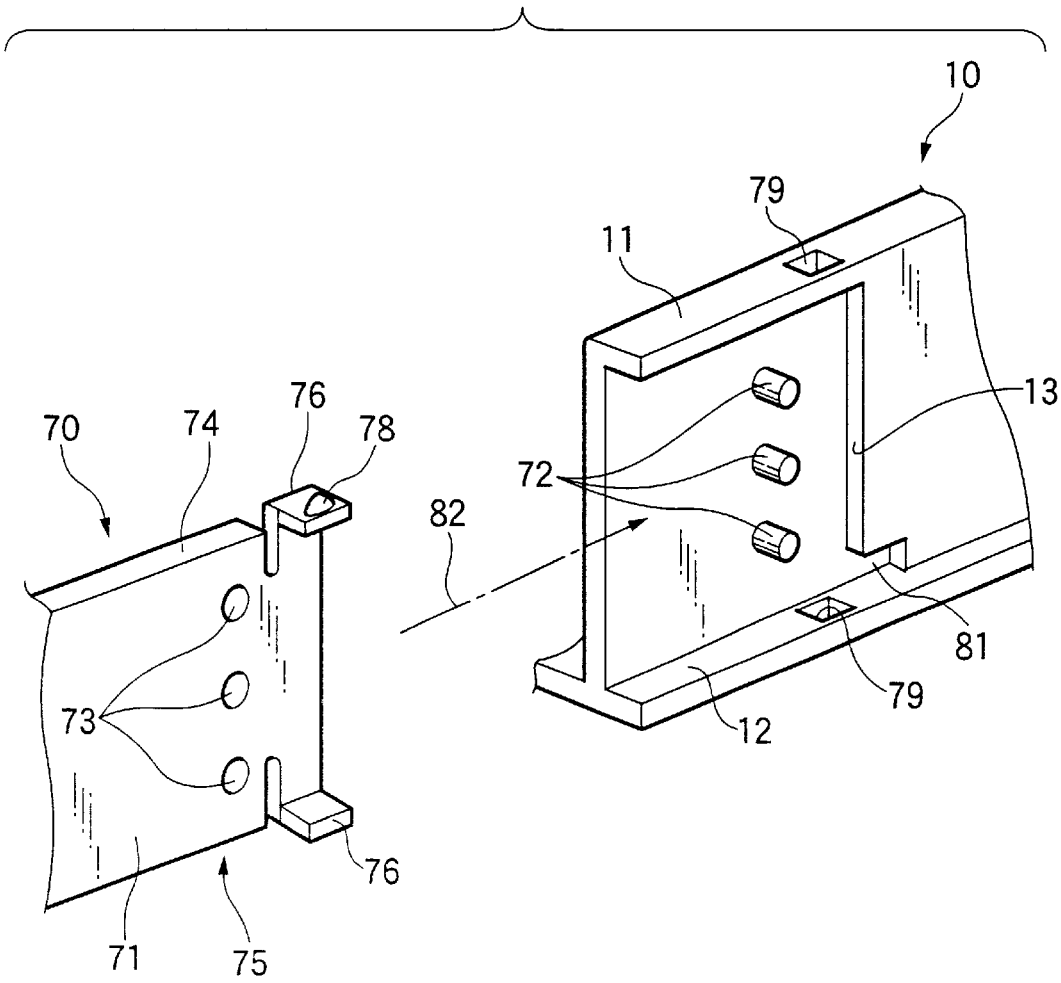
FIG. 15 is a perspective view illustrating a state in which the handle attaching portion is not assembled yet.
Figure 16:
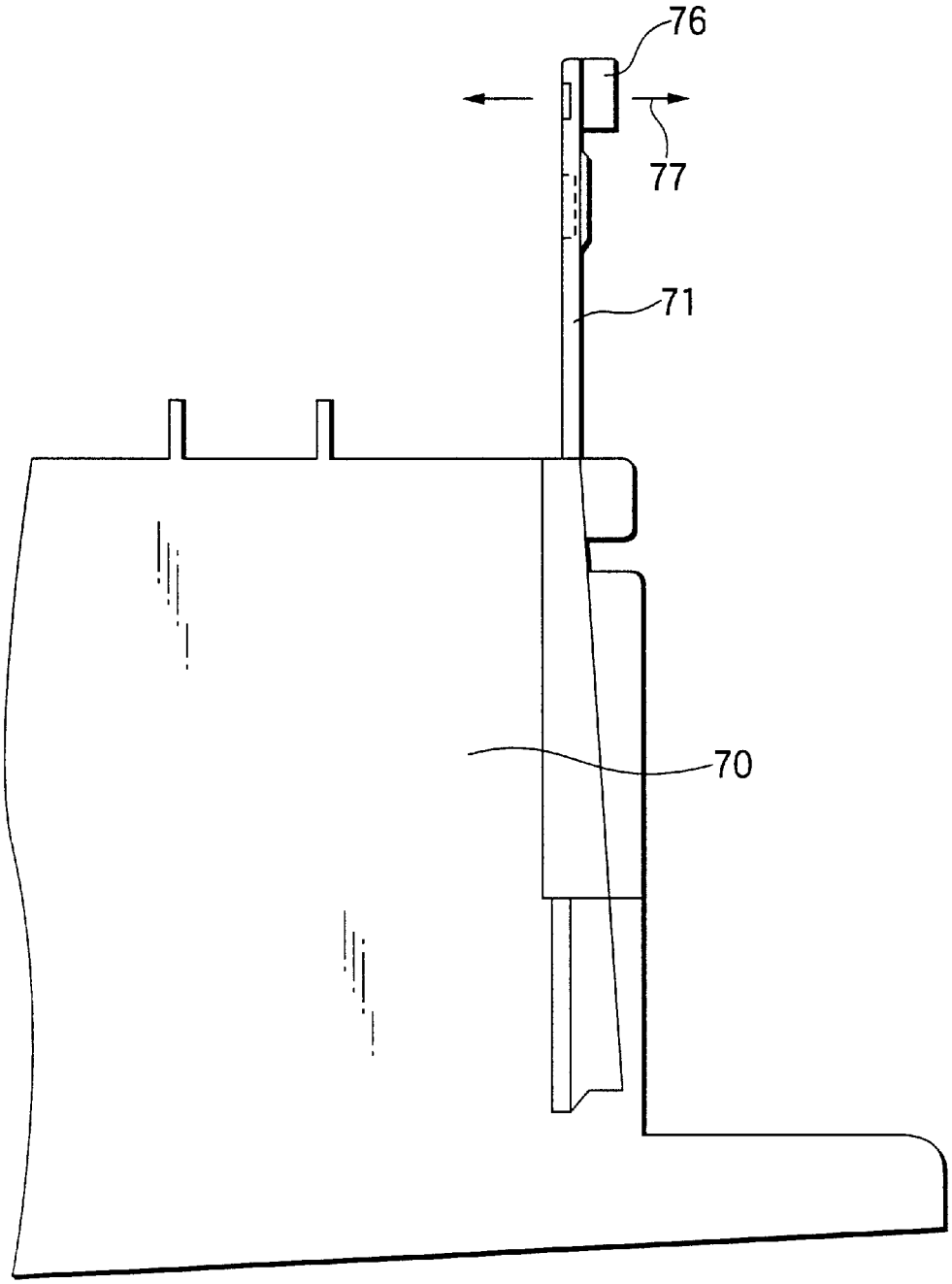
FIG. 16 is a sectional view in a direction of arrows along line E—E of FIG. 14.
Figure 17:
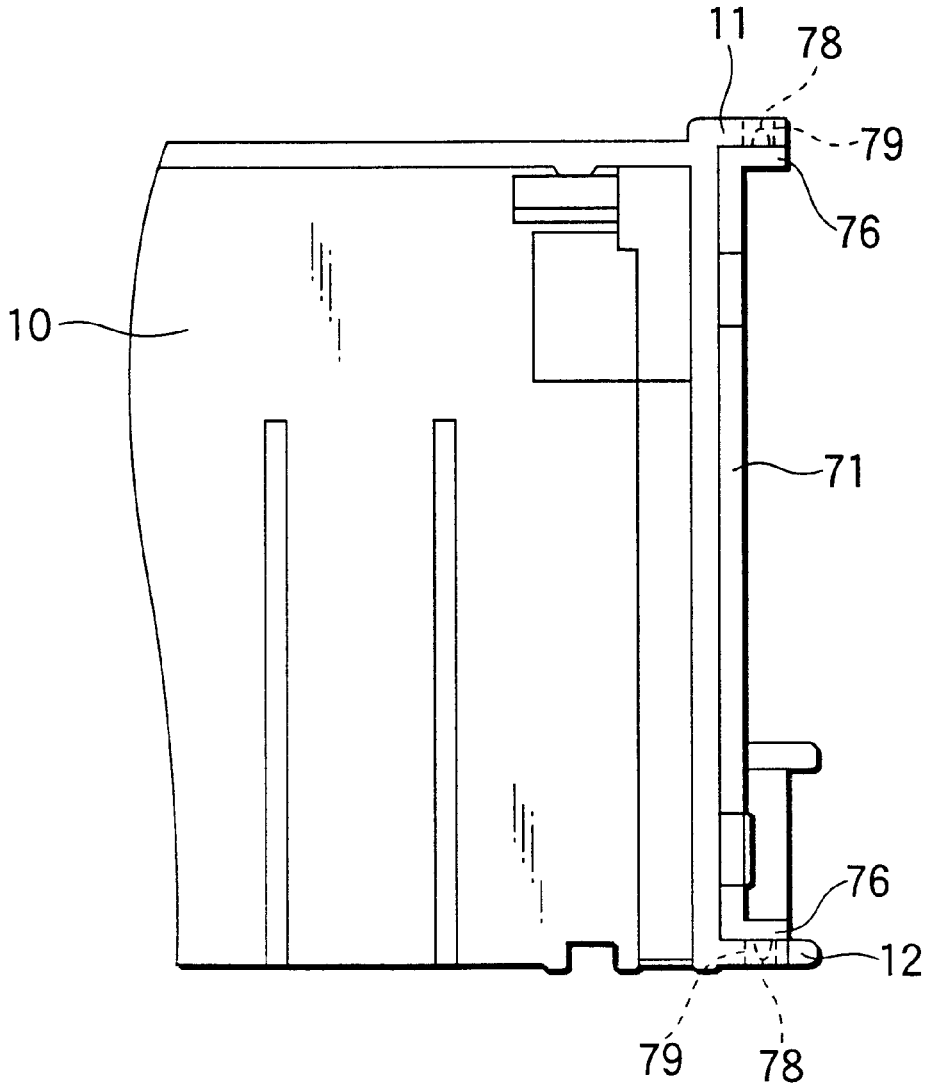
FIG. 17 is a plan view illustrating members of the handle attaching portion.

Next, a structure for attachment between a paper feed tray body (that is, the casing 10) and a drawer handle member 70 provided in front of the paper feed tray is described hereinbelow. FIG. 14 is a side view illustrating an attaching portion where the drawer handle member 70 is attached to the tray body 10 according to the embodiment of the invention. FIG. 15 is a perspective view illustrating a state in which the handle attaching portion is not assembled yet. FIG. 16 is a sectional view taken in a direction of arrows along line E—E of FIG. 14. FIG. 17 is a sectional view taken in a direction of arrows along line F—F of FIG. 14. The drawer handle member 70 attaches/detaches the traybody 10 to/from an image forming apparatus and constitutes a part of an exterior cover of the image forming apparatus. The tray body 10 and the drawer handle member 70 are constituted by different members, respectively. A member for fixing each of the tray body 10 and the drawer handle member 70 comprises an elastic piece, which has an engaging portion and can elastically deform, and an engaged portion with which this engaging portion is engaged. With such a configuration, even when variation in design of the exterior cover occurs, the variation in design thereof can be coped with by changing only the drawer handle portion. Thus, the image forming apparatus can be used without changing the tray body thereof. Moreover, even when models of image forming apparatus differ in exterior cover from one another, the tray body is designed to be used in common thereamong so that the tray body can be reused among such models of the image forming apparatus. Furthermore, all the members of the tray can be reused. A plate-like elastically deformable arm member 71 is extended in a direction where the tray body 10 is attached to and detached from the image forming apparatus. The drawer handle member 70 is fixed to a positioning stationary portion provided in the tray body 10.

As illustrated in FIG. 15, the drawer handle member 70 is attached to the tray body 10 by being pushed into a side portion of the body 10 in an insertion direction indicated by an arrow 82. The drawer handle member 70 has the side-plate-like arm member 71. The arm member 71 is inserted into and firmly fixed to a concave portion formed of upper and lower flanges 11 and 12 and a wall 13 provided on a side plate of the tray body 10. A load and a bending moment applied to the drawer handle member 70 are born by the top and bottom surfaces 74, 75 of the arm member 71, which abut against the upper and lower flanges 11 and 12 of the tray body 10 and the front end surface of the member 71, which abuts against the wall 13 of the tray body 10. The member 70 is adapted so that a component in a direction 80 (see FIG. 14) of a force exerted by the tray body 10 is supported in a direction perpendicular to the thickness of the arm member 71. Thus, the arm member 71 can withstand impacts, which are caused by holding, attaching and detaching a heavy paper feed tray, by using a simple structure. Moreover, the arm member 71 is provided to abut against the wall 13 provided on the sidewall of the tray body so as to be nearly perpendicular to a direction in which the tray is attached to and detached from the apparatus. Thus, the arm member 71 can hold the weight of the tray by using a space equal to that of the tray according to the related art. Further, the arm member 71 can withstand impacts that are caused by attaching the tray to and detaching the tray from the apparatus.

The tray body 10 has a positioning projection (that is, the engaging portion) 72. The arm member 71 has a hole (that is, the engaged portion) 73 into which this projection 72 is fitted. Further, the arm member 71 has snaps 76, which are snap-fitted into the tray body 10, at the top and bottom parts of a tray-side end portion. Each of these snaps 76 is a rectangular elastic piece and has a projection 78 to be fitted into a hole 79 provided in a corresponding one of the flanges 11 and 12 of the tray body 10, as shown in FIGS. 14, 15, and 16. The projection 78 of each of the snaps 76 is elastically fitted thereinto in a direction of an arrow 77 (that is, in a direction in which engaging with each other), as shown in FIG. 16. This direction is perpendicular to the direction 80 of the force applied to the handle member 70. Thus, the snap-fitting does not become off owing to a load imposed on the handle member 70. Accordingly, detachment between the engaging portion and the engaged portion can be more reliably prevented by the simple structure. Incidentally, in case that the tray body 10 and the handle member 70 are formed from different synthetic resins, respectively and the synthetic resin used for forming the tray body 10 is a durable material, the tray body 10 is hard to be worn down and damaged. Thus, when the design of the tray is changed and/or the tray is reused, the reuse thereof can be performed a plurality of times.

When the tray body 10 is lifted by using the drawer handle member 70, a large twisting force is generated in each of the tray body 10 and the handle member 70. This twisting force is concentrated in a stationary part of each of the tray body 10 and the handle member 70. Thus, according to the invention, a direction, in which the force is applied, is set to be different from the direction, in which the snap-fitting is off and to be oriented about 90 degrees away therefrom. Further, the arm member 71 undergoing the force at the side of the handle member 70 is formed so that the force is applied thereto in a direction perpendicular to the thickness of the arm member 71. Furthermore, the structure is adapted so that the arm member 71 is held with the upper flange 11 and the lower flange 12 of the tray body 10. Consequently, even when screw fastening is not used, the disengagement of a snap claw is not caused by the large twisting force applied between the tray body 10 and the handle member 70. Moreover, spaces, such as the cutout and the concave portion 81, are provided adjacent to the snap 76 that is an elastic piece of the stationary member. In case that the drawer handle member 70 is disassembled from the tray body 10, the snap 76 can be elastically deformed through the space provided adjacent to the snap 76 serving as the elastic piece. The engaging portion and the engaged portion can easily be detached from each other.

Figure 18:
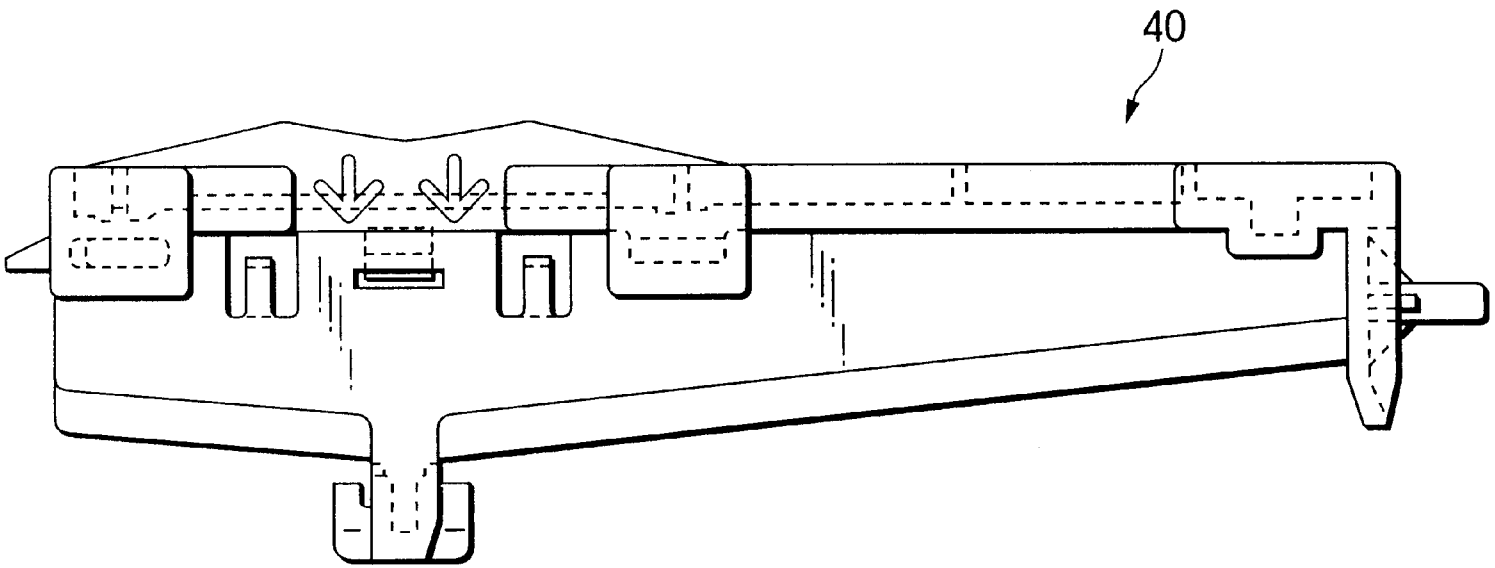
FIG. 18 is a plan view illustrating an end guide.
Figure 19:
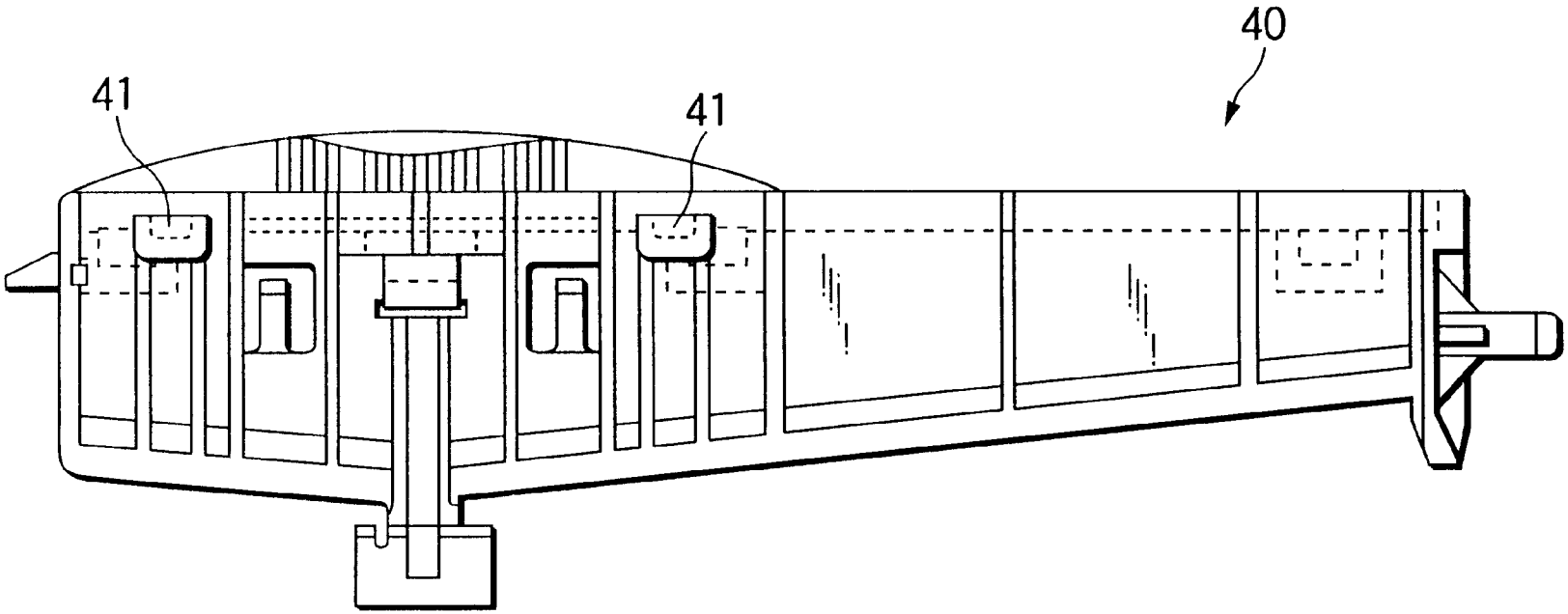
FIG. 19 is a bottom view illustrating the end guide.
Figure 20:
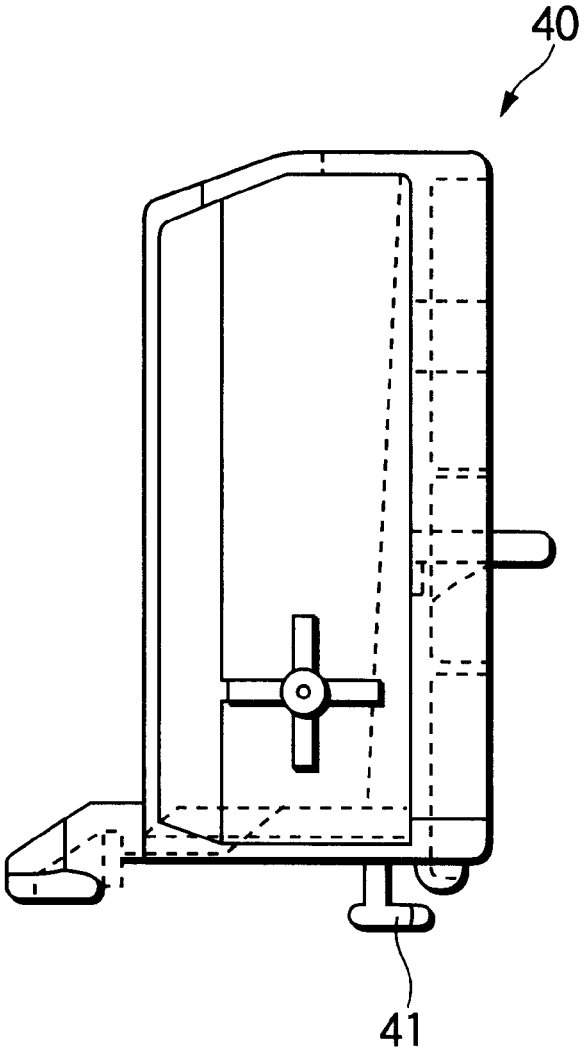
FIG. 20 is a side view illustrating the end guide.
Figure 21:
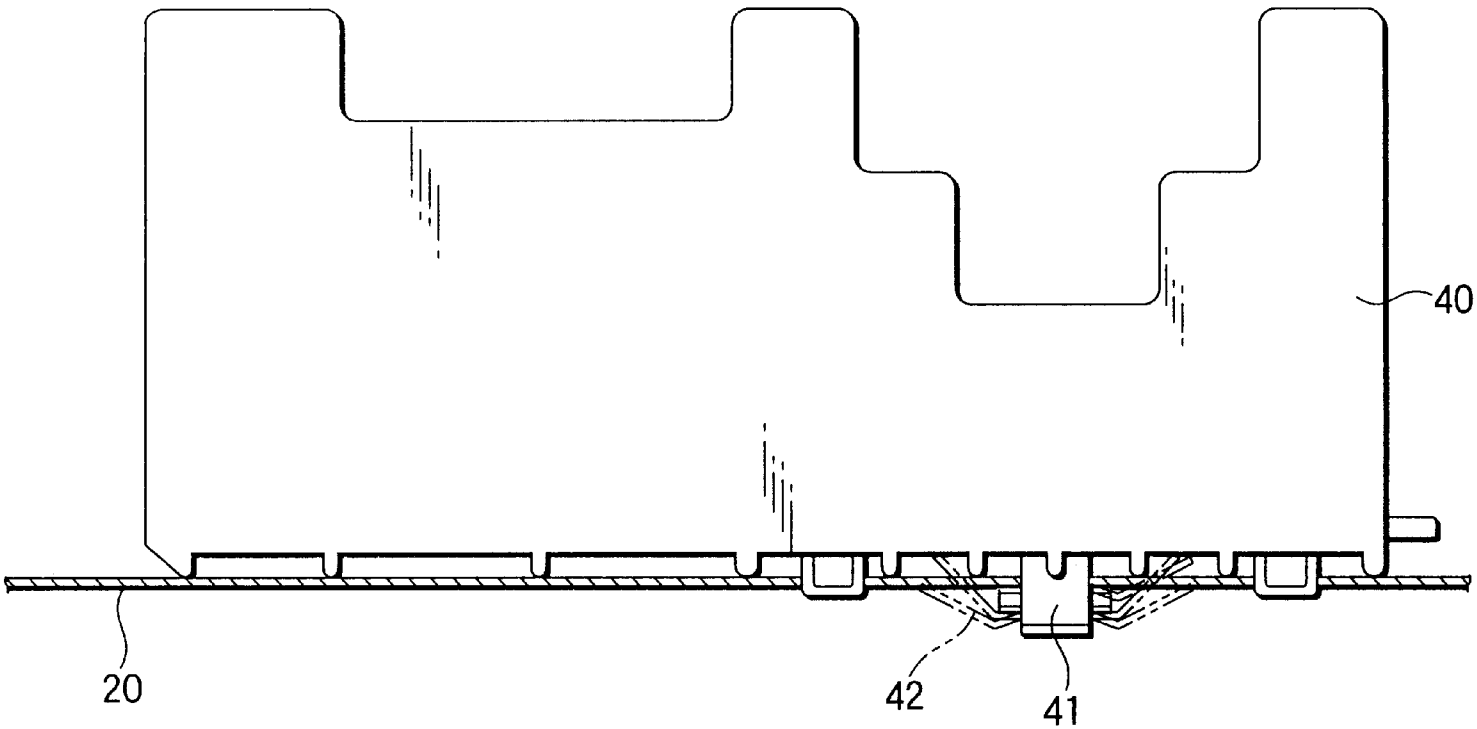
FIG. 21 is a rear view illustrating the end guide.
Figure 22A:
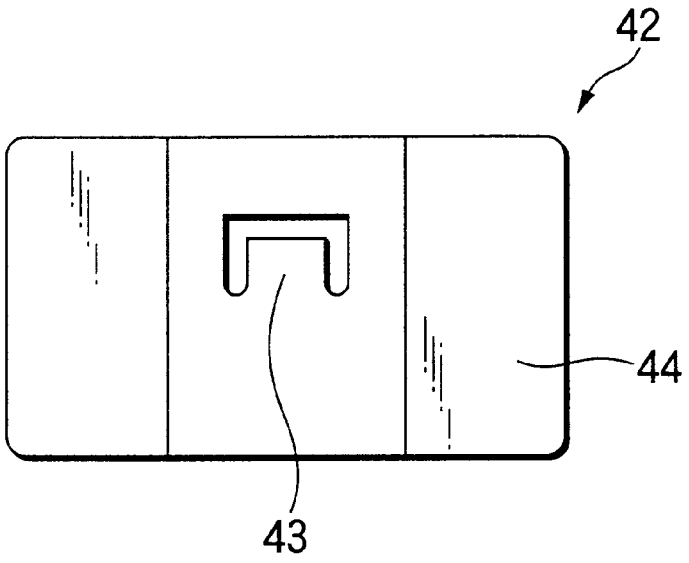
FIGS. 22A and 22B are a plan view of a resin member and a side view thereof, respectively.
Figure 22B:
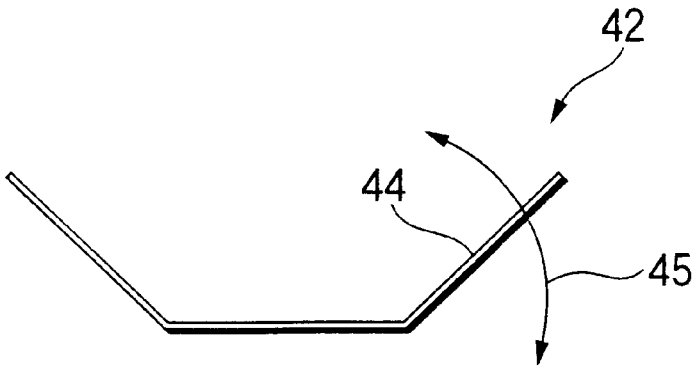
Figure 23:
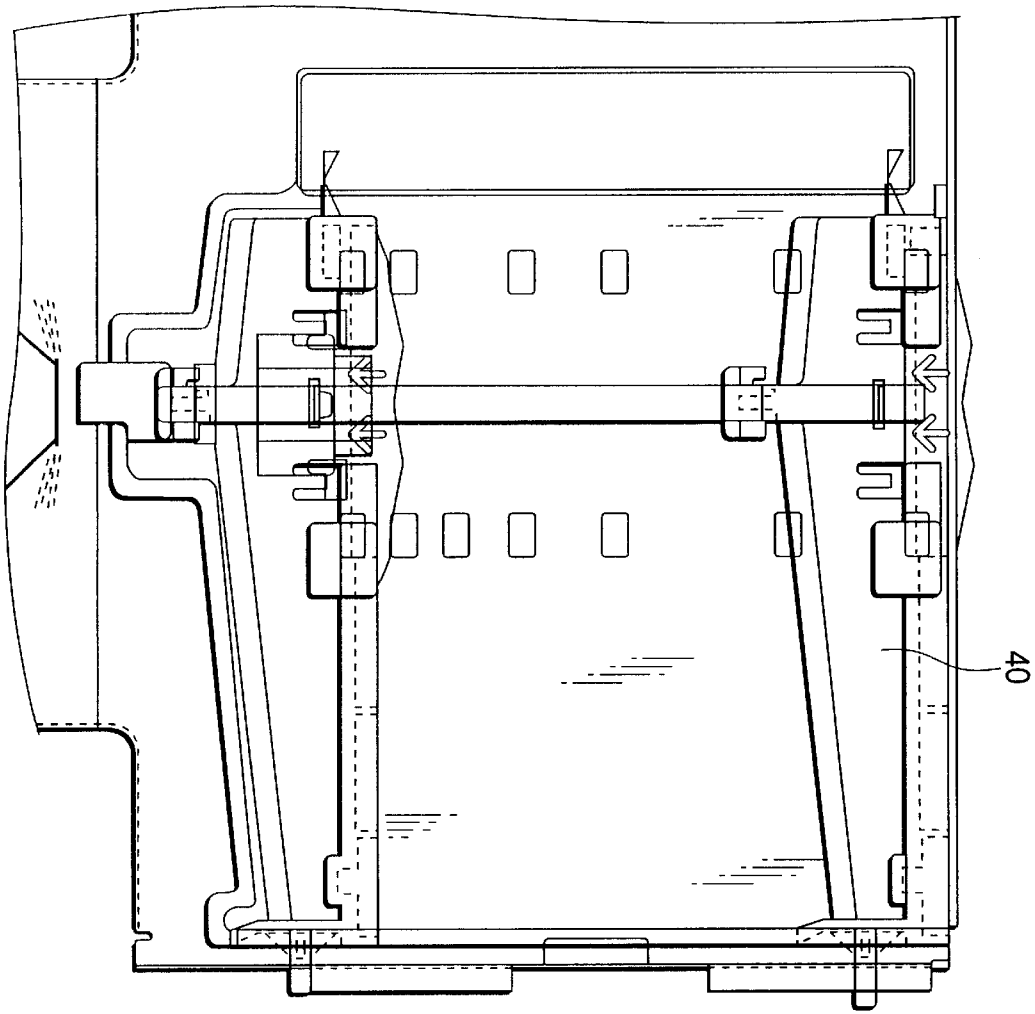
FIG. 23 is a plan view illustrating an end guide mounting portion.

Next, the improvement of the end guide according to the invention is described hereinbelow. An elastic leaf spring is used as a member for holding the base of the end guide. The member configuration thereof is adapted so that when the end guide is set at a predetermined place, the end guide is firmly held thereat by using the elasticity of the leaf spring. FIG. 18 is a plan view of the end guide 40. FIG. 19 is a bottom view thereof. FIG. 20 is a side view thereof. FIG. 21 is a front view thereof. The end guide 40 has a hook 41 provided on the bottom surface thereof. A member for holding the base of the end guide and for regulating the end guide to prevent the end guide from slipping off from the paper loading plate is installed at this hook 41. FIG. 21 illustrates a state in which the hook 41 penetrates through the paper loading plate 20 and a member 42 being in contact with the bottom surface of the paper loading plate 20 is attached to the hook 41. This member 42 has a structure adapted to bend when the end guide 40 is moved and to enable the end guide 40 to easily move without coming off therefrom. In case that this member 42 is made of a metal, there is a fear that foreign sounds are generated between this member and the paper loading plate during an operation of moving the position of the end guide. Thus, a resin sheet member is used as this member 42. This prevents the generation of foreign sounds. FIG. 22 illustrates this member (that is, the resin sheet member) 42. This member 42 is provided with an attaching portion, which is shaped like a rectangle as a whole and has a U-shaped cutout 43 and is bent both the wings to be formed like a trough. Both the wings 44 are elastically displaceable in a direction of an arrow 45 and have bending elasticity. When this member 42 is installed at the end guide, the member 42 can easily be assembled without tools by utilizing the elasticity thereof. When assembling and disassembling this member 42, tools are unnecessary because of the use of elasticity of this resin sheet member 42. Thus, the attachment and removal of this member 42 can easily be performed. In this member 42, a flexible portion thereof to be used for assembling thereof is formed separately from another flexible portion adapted to bend during the movement of the end guide. Concretely, as illustrated in FIG. 22, a U-shaped cutout portion 43 is provided in the member 42 for assembling thereof. When the end guide is attached to the tray, a projection member provided inside the U-shaped cutout portion 43 is bent and fitted to the end guide. When the end guide is moved, this member can be operated by bending both the wing portions 44 thereof without bending the projection provided inside the U-shaped cutout. Thus, the end guide does not slip off therefrom during the operation of moving the end guide. Further, FIG. 23 illustrates a state in which a similar elastic member 46 is installed at a paper end abutting portion of the end guide. This elastic member 46 can easily installed thereat, similarly as the member 42, and is thus preferable.

Figure 24:
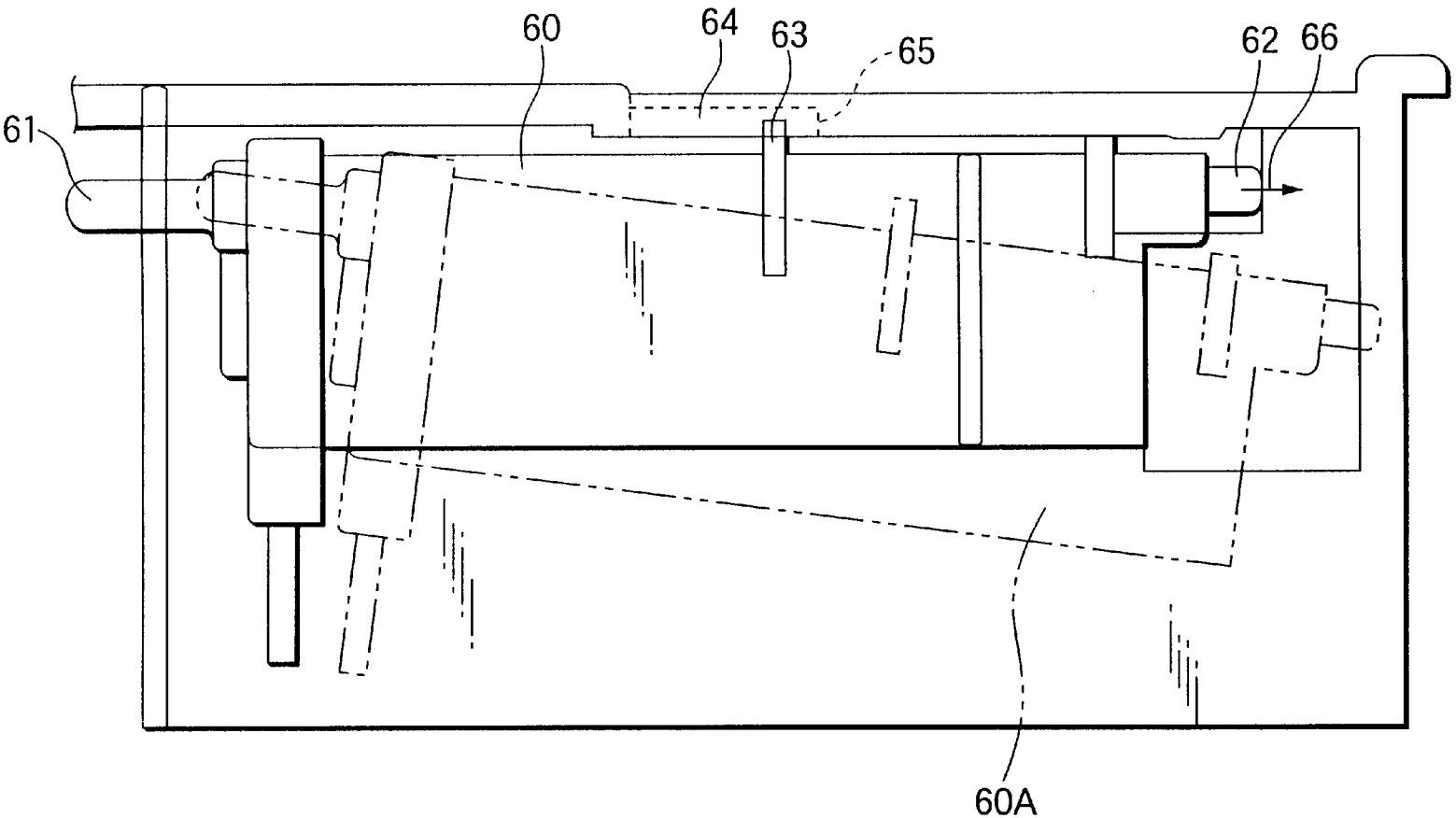
FIG. 24 is a plan view illustrating a retard member mounting process.

Next, a holding member 61 of the retard roll 60 is described hereinbelow. In order to ensure the paper feed performance, a retard roll is required to restrain variation in position as much as possible. Usually, after the retard roll holding member 61 is attached to the tray body 10, the positioning is performed by using another member. According to the invention, the tray has a structure in which a projection portion for regulating the position of the retard roll holding member 61 is provided in the member 61 and a installing-side positioning member has elasticity. When assembling the tray, the counterpart positioning member can be pushed up and moved to a normal position by the projection portion, which is provided in the retard roll holding member, for regulating the position of the holding member. FIG. 24 is an explanatory view illustrating an attachment process of attaching the retard roll holding member 61. The retard roll holding member 61 has a left-hand side attachment shaft 63 and a right-hand side attachment shaft 62, which are provided at both ends thereof as projections for regulating the position thereof. The shaft 62 is set as a long shaft, while the shaft 63 is set as a short shaft. Further, the retard roll holding member 61 has a positioning member 64. The positioning member 64 is a flexible plate-like element and operative to abut against a positioning claw 67 at the main body side to prevent the retard roll holding member 621 from laterally moving. On the other hand, an attachment-side frame, to which this holding member 61 is attached, has bearing holes 65 and 66, into which the attachment shafts 62 and 63 provided at both ends of the retard roll are fitted, respectively and also has the positioning claw 67 adapted to abut against the positioning member 64 to perform positioning. The attachment of the holding member 61 is performed as follows. The holding member 60A is first positioned as indicated by imaginary lines in FIG. 24. Then, the long shaft 62 is passed through the bearing hole 65 to the base thereof so that the holding member 61 is pushed up to an attachment position. The positioning member 64 gets on the positioning claw 67. At that time, the positioning member is elastically deformed. The short shaft 63 is faced to the bearing hole 66 by maintaining the position of the positioning member. When the holding member 61 is moved in a direction in which the short shaft 63 enters the bearing hole 66, the positioning member 64 coincides with a positioning location of the positioning claw 67 and the holding member 61 is set at a predetermined position so that the holding member 61 is restrained from moving toward the long shaft. The invention provides a structure in which the shafts 62 and 63 and the positioning member 64 are provided in the holding member 61 itself so that the positioning capability is imparted thereto and the elasticity is provided thereto when the tray is assembled.

As is apparent from the foregoing description, the paper feed tray according to the invention employs the snap-fit structure for all the attachments among the members and does not employ screw fastening therefor at all. Therefore, the assembling and disassembling thereof are easily achieved.

Moreover, the paper feed tray according to the invention is constituted only by the members that enable all the steps of tray assembling and disassembling processes from the same direction without changing the orientation of the tray. Therefore, the assembling process is rationalized. Moreover, manipulations and maintenance operations are easily performed.

The paper feed tray according to the invention is configured as described above. Therefore, the paper feed trays can be manufactured at low cost by eliminating complexity of assembling the paper feed tray. Further, when being conscious of recycling and reuse of the components of the paper feed tray, the disassembling of the paper feed tray is easily achieved. The sorting of members of the paper feed tray into members to be recycled or reused and members to be abandoned is instantaneously achieved.

What is claimed is:

1. A paper feed tray comprising:

a casing;

a paper loading plate for loading paper thereon, the paper loading plate provided on a bottom portion of the casing;

a side guide for regulating a side portion of a sheet of paper;

an end guide for determining a position of a tail edge of a sheet of paper;

a paper separating member for separating paper sheet by sheet;

a casing attaching/detaching handle;

an operation tab attached to the side guide for regulating the paper separating member; and a catching portion for catching the paper separating member, the catching portion formed between the side guide and the operation tab.

2. The paper feed tray according to claim 1, wherein the paper separating member is a paper separating claw; and a fulcrum of the paper feed claw is formed to be integral with a shaft for fitting the operation tab into the side guide.

3. The paper feed tray according to claim 2, further comprising a snap disposed so that a force received by the paper separating claw from paper during supply of paper acts in a direction in which snap-fitting performed on the operation tab to be utilized at assembling of the tray does not become off.

4. A paper feed tray comprising:

a tray body;

a drawer handle member provided on the tray body, for attaching/detaching the tray body to/from an image forming apparatus, the drawer handle member constituting a part of an exterior cover of the image forming apparatus; and a fixing member having an elastic piece and an engaged portion, wherein the elastic piece is elastically deformable, has an engaging portion, and is provided on one of the tray body and the drawer handle member;

the engaged portion and is provided on the other thereof;

the tray body and the drawer handle member comprise at least two constituent members;

the engaging portion and the engaged portion is engaged with each other to fix the tray body and the drawer handle member to each other.

5. The paper feed tray according to claim 4, wherein the fixing member consists of the elastic piece and the engaged portion.

6. The paper feed tray according to claim 4, wherein when the tray body is attached to and detached from the image forming apparatus, a direction of a force applied to the fixing member is different from a direction in which the engaging portion is engaged with the engaged portion.

7. The paper feed tray according to claim 4, wherein when the tray body is lifted by holding the drawer handle member, a direction of a force applied to the fixing member is different from a direction in which the engaging portion is engaged with the engaged portion.

8. The paper feed tray according to claim 4, wherein a direction in which the engaging portion is engaged with the engaged portion is substantially perpendicular to a direction in which the tray body is attached to and detached from the image forming apparatus.

9. The paper feed tray according to claim 4, wherein the tray body and the drawer handle member are made of different synthetic resins; and the synthetic resin constituting the tray body is a more durable material than that constituting the drawer handle member.

10. The paper feed tray according to claim 4, further comprising a pair of plate-like arm members provided at both end portions of the drawer handle member, respectively, the plate-like members extended in a direction in which the tray body is attached to and detached from the image forming apparatus, wherein a force received from the tray body is applied to each of the arm members in a direction perpendicular to a direction of thickness thereof.

11. The paper feed tray according to claim 10, wherein each of the arm members is provided to abut against a wall surface that is provided on a sidewall of the tray body and extends in a direction substantially perpendicular to the direction in which the tray body is attached to and detached from the image forming apparatus.

12. The paper feed tray according to claim 4, wherein a space is defined adjacent to the elastic piece.

13. The paper feed tray according to claim 12, wherein the space is a concave portion provided in a sidewall of the tray body.

14. A paper feed tray comprising:

a tray body;

a drawer handle member provided on the tray body, for attaching/detaching the tray body to/from an image forming apparatus and, the drawer handle member constituting a part of an exterior cover of the image forming apparatus;

a fixing member for fixing the tray body and the drawer handle member to each other, provided on one of the tray body and the handle drawer member;

an arm member having a plate-like shape, being elastically deformable, and extending in a direction in which the tray body is attached to and detached from the image forming apparatus;

a fixing portion for positioning and fixing the arm member, provided on the other thereof.

15. The paper feed tray according to claim 14, wherein the arm member is provided to be parallel to a sidewall of the tray body; and the fixing portion abuts against a plate-thickness surface of the arm member to position and fix the arm member.

16. The paper feed tray according to claim 14, wherein the arm member is elastically deformable in a direction substantially perpendicular to a direction in which the tray body is attached to and detached from the image forming apparatus.

* * * * *